US008465892B2

(12) United States Patent
Yu

(10) Patent No.: US 8,465,892 B2
(45) **Date of Patent: *Jun. 18, 2013**

(54) CHEMICALLY RESISTIVE AND LUBRICATED OVERCOAT

(75) Inventor: Robert C. U. Yu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 216 days.

This patent is subject to a terminal disclaimer.

(21) Appl. No.: 13/051,951

(22) Filed: Mar. 18, 2011

(65) Prior Publication Data

US 2012/0237862 A1 Sep. 20, 2012

(51) Int. Cl.
*G03G 5/00* (2006.01)

(52) U.S. Cl.
USPC ..... 430/66; 399/159

(58) Field of Classification Search
USPC ..... 430/66; 399/159
See application file for complete search history.

(56) References Cited

U.S. PATENT DOCUMENTS 3,121,006 A 2/1964 Middleton et al.
3,820,989 A 6/1974 Rule et al.
3,837,851 A 9/1974 Shattuck et al.
3,895,944 A 7/1975 Wiedemann et al.
4,150,987 A 4/1979 Anderson et al.
4,245,021 A 1/1981 Kazami et al.
4,256,821 A 3/1981 Enomoto et al.
4,265,990 A 5/1981 Stolka et al.
4,278,746 A 7/1981 Goto et al.
4,286,033 A 8/1981 Neyhart et al.
4,291,110 A 9/1981 Lee
4,297,426 A 10/1981 Sakai et al.
4,315,982 A 2/1982 Ishikawa et al.
4,338,387 A 7/1982 Hewitt
4,338,388 A 7/1982 Sakai et al.
4,385,106 A 5/1983 Sakai
4,387,147 A 6/1983 Sakai
4,399,207 A 8/1983 Sakai et al.
4,399,208 A 8/1983 Takasu et al.
4,587,189 A 5/1986 Hor et al.
4,664,995 A 5/1987 Horgan et al.
4,988,597 A 1/1991 Spiewak et al.
5,244,762 A 9/1993 Spiewak et al.
5,697,024 A 12/1997 Mishra
5,703,487 A 12/1997 Mishra
5,756,245 A 5/1998 Esteghamatian et al.
6,008,653 A 12/1999 Popovic et al.
6,119,536 A 9/2000 Popovic et al.
6,124,514 A 9/2000 Emmrich et al.

(Continued)

OTHER PUBLICATIONS

U.S. Appl. No. 13/034,654, filed Feb. 24, 2011, entitled "Electrically Tunable and Stable Imaging Members." Vu at al.

(Continued)

*Primary Examiner* — Mark A Chapman
(74) *Attorney, Agent, or Firm* — Pillsbury Winthrop Shaw Pittman LLP

(57) ABSTRACT

Embodiments provide novel imaging members used in electrostatography. More particularly, there is provided flexible electrophotographic imaging members which exhibit an extended functional life. These imaging members include an improved protective overcoat layer comprising: (1) a polymer blend of a low surface energy copolymer and a chemically resistive copolymer, (2) a chemically resistive copolymer and a slip agent, and (3) a chemically resistive copolymer and the dispersion of a low surface energy Polyhedral Oligomeric Silsesquioxane (POSS) nanoparticles to effect surface contact friction reduction for enhancing wear resistance and for suppressing copy printout defect caused by chemical attack.

21 Claims, 3 Drawing Sheets

U.S. PATENT DOCUMENTS

| | | | |
|---|---|---|---|
| 6,150,824 | A | 11/2000 | Mishra et al. |
| 6,214,514 | B1 | 4/2001 | Evans et al. |
| 6,756,169 | B2 | 6/2004 | Lin et al. |
| 6,933,089 | B2 | 8/2005 | Horgan et al. |
| 7,018,756 | B2 | 3/2006 | Pai et al. |
| 7,033,714 | B2 | 4/2006 | Horgan et al. |
| 7,504,187 | B2 | 3/2009 | Yu et al. |
| 2009/0253058 | A1 | 10/2009 | Yu |
| 2009/0253060 | A1 | 10/2009 | Yu |
| 2011/0305981 | A1* | 12/2011 | Yu et al. ..... 430/56 |

OTHER PUBLICATIONS

U.S. Appl. No. 12/828,138, filed Jun. 30, 2010, entitled "Imaging Members Having a Chemical Resistive Overcoat Layer," Vu et al.

* cited by examiner

CHEMICALLY RESISTIVE AND LUBRICATED OVERCOAT

BACKGROUND

The presently disclosed embodiments are directed to imaging members used in electrostatography. More particularly, the embodiments pertain to electrophotographic imaging members which have improved formulations to effect surface contact friction reduction for wear resistant enhancement and suppress copy printout defect caused by chemical attack through the addition of a protective overcoat layer prepared to comprise of: (1) a polymer blend of a low surface energy copolymer and a chemically resistive copolymer, (2) a chemically resistive copolymer and a slip agent, and (3) a chemically resistive copolymer and a dispersion of a low surface energy Polyhedral Oligomeric Silsesquioxane (POSS) nanoparticles. This disclosure relates to all types of electrophotographic imaging members used in electrophotography.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Flexible electrostatographic imaging members are well known in the art. Typical electrostatographic imaging members include, for example: (1) electrophotographic imaging members (photoreceptors) commonly utilized in electrophotographic (xerographic) processing systems; (2) electroreceptors such as ionographic imaging members for electrographic imaging systems; and (3) intermediate toner image transfer members such as an intermediate toner image transferring belt which is used to remove the toner images from a photoreceptor surface and then transfer the very images onto a receiving paper. All the electrostatographic imaging members are prepared in either flexible belt form or rigid drum configuration and could either be a negatively charged or positively charged design.

For a typical flexible electrophotographic imaging member belt used in a negatively charged imaging system, the imaging member belt comprises a charge transport layer, a charge generating layer, and optional layers on one side of a supporting substrate layer and does also include an anticurl back coating on the opposite side of the substrate to imaging member flatness. In this flexible electrophotographic imaging member, where the charge generating layer is sandwiched between the top outermost exposed charge transport layer and the electrically conducting layer, the outer surface of the charge transport layer is charged negatively and the conductive layer is charged positively. The charge generating layer should be capable of generating electron hole pair when exposed imagewise and inject only the holes through the charge transport layer. In the alternate case where the charge transport layer is sandwiched between the charge generating layer and the conductive layer, the outer surface of the charge generating layer is charged positively while conductive layer is charged negatively and the holes are injected through from the charge generating layer to the charge transport layer. The charge transport layer should be able to transport the holes with as little trapping of charge as possible. In a typical flexible imaging member belt such as photoreceptor, the charge conductive layer may be a thin coating of metal on a flexible substrate support layer which also provided with an anticurl back coating to render imaging member flatness.

A typical flexible electrographic imaging member belt may, however, have a more simple material structure and include a dielectric imaging layer on one side of a supporting substrate and an anti-curl back coating on the opposite side of the substrate to render flatness. Alternatively, the electrostatographic imaging members can also be a rigid member, such as those utilizing a rigid substrate support drum. For these drum imaging members, having a thick and rigid cylindrical supporting substrate bearing the imaging layer(s), no application of an anticurl back coating layer is needed.

All the flexible electrostatographic imaging members may be seamless or seamed belts. Seamed belts are usually formed by cutting a rectangular sheet from a web, overlapping opposite ends, and welding the overlapped ends together to form a welded seam.

Although the scope of the present embodiments covers the preparation of all types of electrostatographic imaging members in flexible belt design or rigid drum configuration, but for reasons of simplicity, the discussion hereinafter will focus and be represented only by flexible electrophotographic imaging member belts of negatively charged design.

Electrophotographic flexible belt imaging members may include a photoconductive layer including a single layer or composite layers. The flexible belt electrophotographic imaging members may be seamless or seamed belts. Seamed belts are usually formed by cutting a rectangular sheet from a web, overlapping opposite ends, and welding the overlapped ends together to form a welded seam. The typical negatively charged electrophotographic imaging member belts include a top outermost exposed charge transport layer directly over a charge generating layer on one side of a supporting substrate layer and an anticurl back coating coated onto the opposite side of the substrate layer to render flatness. By comparison, a typical electrographic imaging member belt does, however, have a more simple material structure; it includes a dielectric imaging layer on one side of a supporting substrate and an anti-curl back coating on the opposite side of the substrate. Since typical negatively-charged flexible electrophotographic imaging members exhibit undesirable upward imaging member curling after completion of coating the top outermost exposed charge transport layer, an anticurl back coating, applied to the backside, is required to balance the curl. Thus, the application of anticurl back coating is key to provide the appropriate imaging member with desirable flatness.

One type of composite photoconductive layer used in xerography is illustrated in U.S. Pat. No. 4,265,990 which describes a negatively-charged photosensitive member having at least two electrically operative layers. One layer comprises a photoconductive layer which is capable of photogenerating holes and injecting the photogenerated holes into a contiguous charge transport layer.

Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer is sandwiched between the outermost exposed charge transport layer and the electrically conducting layer, the outer surface of the charge transport layer is charged negatively and the conductive layer is charged positively. The charge generating layer then should be capable of generating electron hole pair when exposed image wise and inject only the holes through the charge transport layer. In the alternate case when the charge transport layer is sandwiched between the charge generating layer and the conductive layer, the surface of the top outermost exposed charge generating layer is charged positively while conductive layer is charged negatively and the holes are injected through from the top exposed charge generating layer to the charge transport layer. The charge transport layer should be able to transport the holes with as little trapping of charge as possible. In a typical flexible imaging member web like photoreceptor, the conductive layer may be a thin coating of metal on a flexible substrate support layer.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, an optional blocking layer, an optional adhesive layer, a charge generating layer, a CTL and a conductive ground strip layer adjacent to one edge of the imaging layers, and an optional overcoat layer adjacent to another edge of the imaging layers. Such a photoreceptor usually further comprises an anticurl back coating layer on the side of the conductive layer/substrate support opposite the side carrying the blocking layer, adhesive layer, charge generating layer, charge transport layer and other layers.

For typically negatively-charged imaging member belts, such as flexible photoreceptor belt designs, they are made of multiple layers comprising a flexible supporting substrate, a conductive ground plane, a charge blocking layer, an optional adhesive layer, a charge generating layer, and a charge transport layer. The charge transport layer is the last and thickest layer to be coated to become the outermost exposed layer and is applied by solution coating then followed by drying the wet applied coating at elevated temperatures of about 115° C., and finally cooling it down to ambient room temperature of about 25° C. When a production web stock of several thousand feet of coated multilayered photoreceptor material is obtained after finishing the charge transport layer coating through drying/cooling process, upward curling of the multilayered photoreceptor is observed.

This upward curling is a consequence of thermal contraction mismatch between the CTL and the substrate support. Since the charge transport layer in a typical photoreceptor device has a coefficient of thermal contraction approximately 3.7 times greater than that of the flexible substrate support, the charge transport layer exhibits a larger dimensional shrinkage than that of the substrate support as the imaging member web stock (after through elevated temperature heating/drying process) as it cools down to ambient room temperature. This dimensional contraction mis-match results in tension strain built-up in the charge transport layer, at this instant, is pulling the imaging member web stock upward to exhibit curling. If unrestrained at this point, the imaging member web stock (using 3½ mil-thick polyethylene terephthalate substrate and a 29 micrometer charge transport layer coated thickness) will spontaneously curl upwardly into a 1.5-inch roll. To offset the curling, an anticurl back coating is applied to the backside of the flexible substrate support, opposite to the side having the charge transport layer, and render the imaging member web stock with desired flatness.

One layer of the flexible imaging member belt, for example, the top outermost exposed charge transport layer of a negatively charge imaging member, is constantly subjected to and suffer from the machine operational conditions, such as exposure to high surface friction interactions and extensive cycling. Such harsh conditions lead to wearing away and susceptibility of surface scratching of the charge transport layer which otherwise adversely affect machine performance. Another imaging member functional problem associated with the charge transport layer is its propensity to give rise to early development of surface filming due its high surface energy; charge transport layer surface filming is undesirable because it does pre-maturely cause degradation of copy print-out quality. Moreover, the outermost exposed charge transport layer is also been found to exhibit early onset of surface cracking, as consequence of repetition of bending stress belt cyclic fatiguing, airborne chemical species exposure, and direct solvent contact, under a normal machine belt functioning condition. charge transport layer cracking is a serious mechanical failure since the cracks do manifest themselves into defects in print-out copies. All these imaging member layers failures are major issues that remain to be resolved as they pre-maturely cut short the functional life of an imaging member and prevent it from reaching the belt life target. Early imaging member functional failure thereby requires frequent costly replacement in the field.

A number of current flexible electrophotographic imaging member belts are multilayered photoreceptor belts that, in a negative charging system, comprise a substrate support, an electrically conductive layer, an optional charge blocking layer, an optional adhesive layer, a charge generating layer, a charge transport layer, and an optional anticurl back coating at the opposite side of the substrate support to render flatness. In such an imaging member belt design, the charge transport layer is therefore the top outermost exposed layer. In a conventional electrophotographic imaging machine design, a flexible imaging member belt is mounted over and encircled around a belt support module comprising numbers of belt support rollers, such that the top outermost exposed charge transport layer is subjected to all electrophotographic imaging subsystems mechanical actions, chemical attacks by corona species emission from charging devices, as well as environmental contaminant vapor exposure. In essence, the top exposed charge transport layer surface of the flexible imaging member belt, during normal machine electrophotographic imaging and cleaning operating conditions, is constantly under physical/mechanical/electrical/chemical interactions, such as for example, the mechanical sliding actions of cleaning blade and cleaning brush, electrical charging devices corona effluents exposure, developer components, image formation toner particles, hard carrier particles, debris and loose $CaCO_3$ particles from receiving paper, and the like during dynamic belt cyclic motion. As a consequence of these interactions against the imaging member belt, the exposed top charge transport layer is found suffer from surface scratching, abrasion, and exacerbating wear. In some instances, the charge transport layer has been found to wear away by as much as 10 micrometers after approximately 20,000 dynamic belt imaging cycles. Excessive charge transport layer wear is a serious problem because it causes significant change in the charged field potential and adversely impacts copy printout quality. Another outcome of charge transport layer wear is the decrease of charge transport layer thickness alters the equilibrium of the balancing forces between the charge transport layer and the anti-curl back coating and impacts imaging member belt flatness. The reduction of charge transport layer thickness by wear causes the imaging member belt to curl downward at both edges. Edge curling in the belt is an important issue because it changes the distance between the belt surface and the charging device(s), causing non-uniform surface charging density which manifests itself as a "smile" print defect on paper copies. Such a print defect is characterized by lower intensity of print-images at the locations over both belt edges. Moreover, the susceptibility of the charge transport layer surface to scratches (caused by interaction against developer carrier beads and the hard $CaCO_3$ particles and debris from paper) has also been identified as a major imaging member belt functional failure since these scratches do manifest themselves as print defects in paper copies. More over, development of charge transport layer surface film due to the result of high surface energy has also frequently been found to be problematic, since the film formed on the charge transport layer surface does affect toner image formation which thereby causes copy print out quality degradation.

Another emerging problem recently found is associated with chemical contaminants exposure/interaction of the outermost exposed charge transport layer, during electrophotographic imaging process in the field. Exposure to chemical species negatively affects the imaging member function. For example, exposure to the vapor amine species (from ammonia) emitted from common house cleaning agents have been seen to interact with the imaging member charge transport layer, causing material degradation to promote pre-mature onset of charge transport layer cracking and exacerbation of wear failure which severely cut short the functional life of the imaging member. In one particular instant, amine vapor impact on copy printout quality degradation has recently been seen when pre-printed papers (papers having pre-printed images which employed amine agents catalyzed ultraviolet (UV) cured ink) are used by customers for subsequent addition of xerographic images over the pre-printed paper blank spaces. Accumulation of amine residues deposition onto the imaging member charge transport layer surface, after repeatedly making contact with receiving papers during xerographic imaging process, is found to cause ghosting image defects print-out in the output copies. Since ghosting image defects in the output copies are unacceptable print quality failures, so it does require frequent costly imaging member replacement in the field. With all these issues and failures described above, therefore there is an urgent need to resolve these issues and extend the service life of the imaging member in the field. In particular, by the formulation of a charge transport layer that is resistive to amine specific effect to resolve the current pre-printed paper ghosting image defects print out problem.

Relevant prior arts to the present disclosure include U.S. Patent Publication No. 20090253060; U.S. Patent Publication No. 20090253058; U.S. patent application Ser. No. 13/034,654; and U.S. patent application Ser. No. 12/828,138.

In addition, U.S. Pat. No. 7,504,187 discloses embodiments of electrophotographic imaging members, such as layered photoreceptor structures and process for making and using the same. In particular, the embodiments pertain to an improved electrophotographic imaging member having a protective overcoat layer comprising a low surface energy polymeric material to enhance the imaging member physical/mechanical function as well as render its service life extension and a process for making and using the member.

The above disclosures show that, while attempts to resolve charge transport layer failures described above have been successful with providing a solution, often times the success is negated due to the creation of another set of problems. Therefore, there is an need to provide improved imaging members that have robust outer layer to effect mechanical function and render resistivity to contaminant exposure/chemical attack for service life extension, without causing the introduction of other undesirable problems.

SUMMARY

According to the present aspects illustrated hereinafter, there is provided an improved protective overcoat layer which is added directly onto the charge transport layer of the imaging member to address the shortcomings and provide effective resolution to the above-mentioned issues associated with conventional charge transport layers. The improved overcoat layer is designed to impact surface slipperiness/contact friction reduction and render chemical resistivity as well as effect imaging member service life extension in the field.

According to the present embodiments, there is provided a flexible imaging member comprising: a flexible substrate; a charge generating layer disposed on the substrate; at least one charge transport layer disposed on the charge generating layer; and an overcoat layer disposed over the at least one charge transport layer, wherein the overcoat layer comprises a blend of a polycarbonate and a low surface energy polycarbonate, and further wherein the polycarbonate is an A-B diblock copolymer comprising a bisphenol A polycarbonate segment block (A) and a phthalic acid containing segment block (B) terminal capable of providing protection against amine species contaminants, selected from the group consisting of Formula (I) and Formula (II) below:

Formula (I)

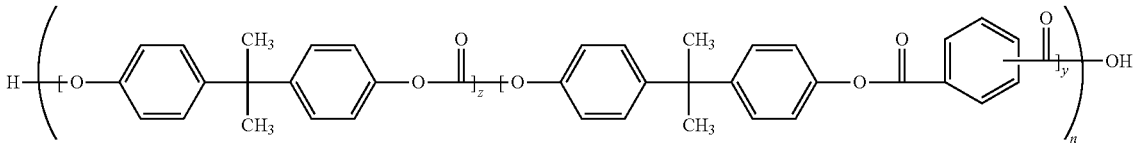

Block (A) Block (B)

-continued

Formula (II)

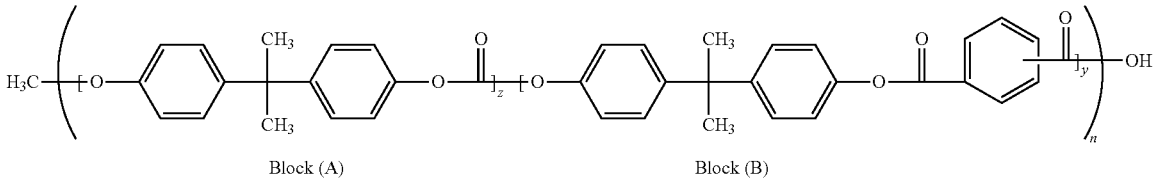

wherein z represents the number of bisphenol A repeating units in block A of from about 9 to about 18, y is number of repeating phthalic acid block B of from about 1 to about 2, and n is the degree of polymerization between about 20 and about 80 for the copolymer having a weight average molecular weight between about 100,000 and about 200,000, and mixtures thereof, while the low surface energy polycarbonate is selected from the group consisting of a bisphenol A polycarbonate of poly(4,4'-isopropylidene diphenyl carbonate) modified by including a small fraction of polydimethyl siloxane (PDMS) linkages in the main polycarbonate chain back bone to obtain Formula (1) below:

Formula (I)

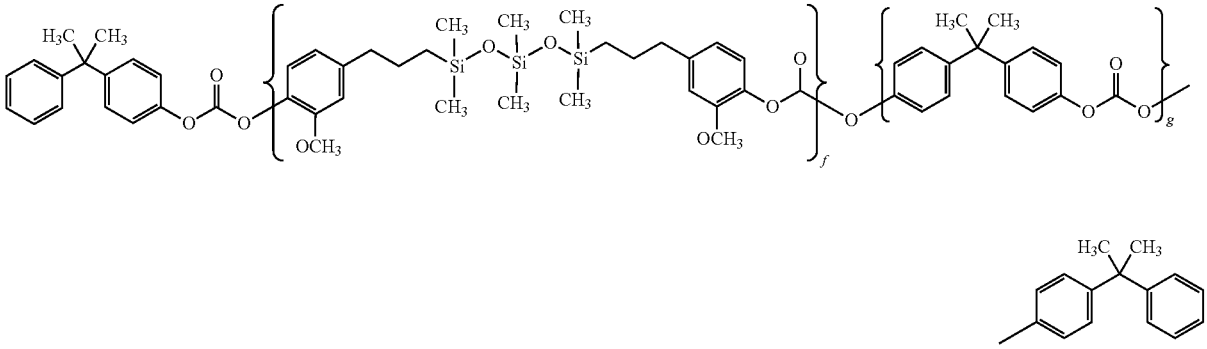

wherein x is a number from about 10 to about 50, and f and g are numbers representing each respective repeating segment such that f is from about 1 to about 4 and g is from about 10 to about 100 determined for a weight average molecular weight of from about 15,000 to about 130,000 of the low surface energy polycarbonate, a bisphenol Z polycarbonate of poly(4,4'-diphenyl-1,1'-cyclohexane carbonate) modified by including a small fraction of polydimethyl siloxane (PDMS) linkages into the main polycarbonate chain back hone to obtain Formula (2) below:

r

Formula (2)

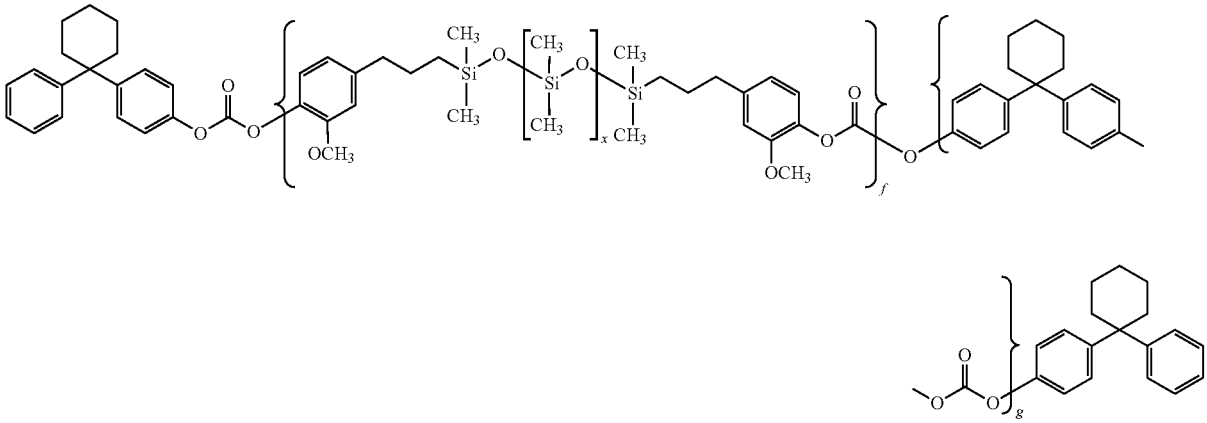

wherein x is a number from about 10 and about 50 while f and g are numbers representing each respective repeating units such that f is between about 1 and about 4 and g is from about 10 to about 100 determined for a weight average molecular weight of from about 15,000 to about 130,000 of the low surface energy polycarbonate, a bisphenol C polycarbonate of poly(4,4'-isopropylidene diphenyl carbonate) modified by including a small fraction of polydimethyl siloxane (PDMS) linkages into the main polycarbonate chain back bone to obtain Formula (3) below:

Formula (3)

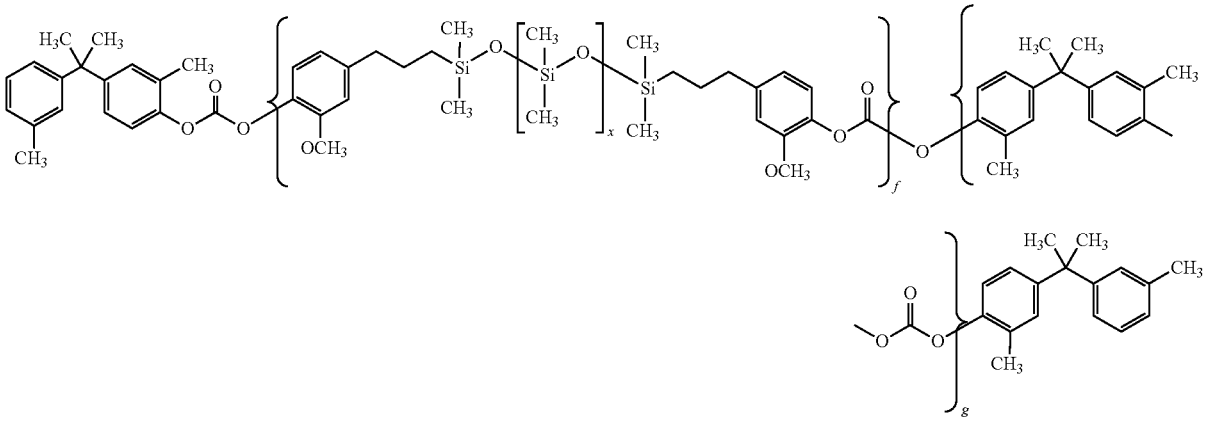

wherein x is a number from about 10 and about 50 while f and g are numbers representing the respective repeating units such that f is between about 1 and about 4 and g is from about 10 to about 100 determined for a weight average molecular weight of from about 15,000 to about 130,000 of the low surface energy polycarbonate, and a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (4) below:

Formula (4)

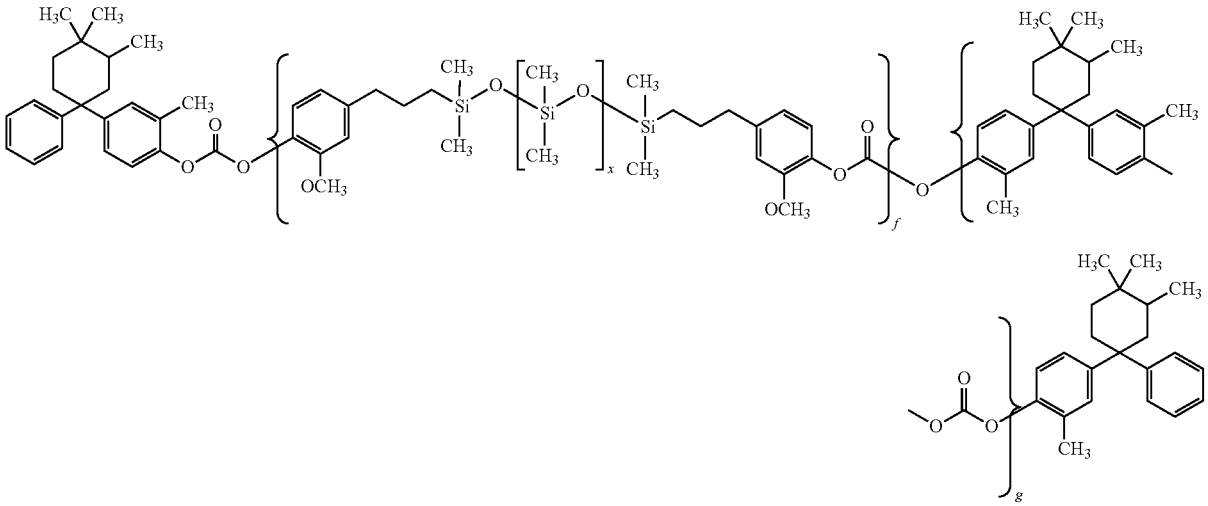

wherein x is a number from about 10 and about 50 while f and g are numbers representing the respective repeating units such that f is between about 1 and about 4 and g is from about 10 to about 100 determined for a weight average molecular weight of from about 15,000 to about 130,000 of the low surface energy polycarbonate, and mixtures thereof; and an anticurl back coating layer disposed on the flexible substrate on a side opposite the charge generating and charge transport layers.

In embodiments, there is provided a flexible imaging member comprising: a flexible substrate; a charge generating layer disposed on the substrate; multiple charge transport layers disposed on the charge generating layer; and an overcoat layer disposed over the multiple charge transport layers, wherein the overcoat layer comprises a blend of a polycarbonate binder and a low surface energy polycarbonate, and further wherein the polycarbonate binder is an A-B diblock copolymer comprising a bisphenol A polycarbonate segment block (A) and a phthalic acid containing segment block (B) terminal capable of providing protection against amine species contaminants, selected from the group consisting of Formula (I) and Formula (II) below:

Formula (I)

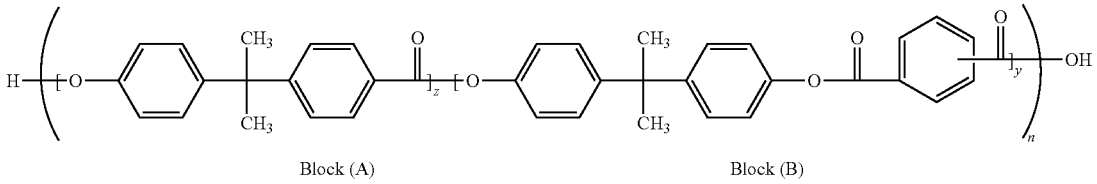

Formula (II)

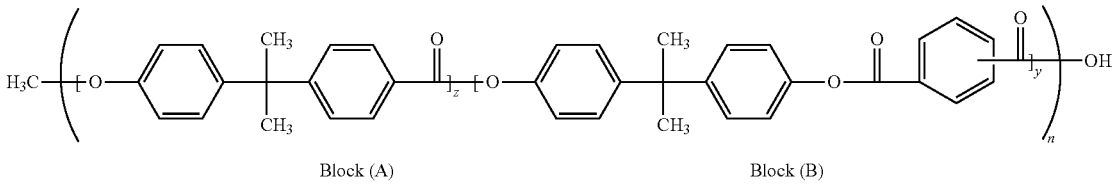

wherein z represents the number of bisphenol A repeating units in block A of from about 9 to about 18, y is number of repeating phthalic acid block B of from about 1 to about 2, and n is the degree of polymerization between about 20 and about 80 for the copolymer having a weight average molecular weight between about 100,000 and about 200,000, and mixtures thereof, while the low surface energy polycarbonate is selected from the group consisting of a bisphenol A polycarbonate of poly(4,4'-isopropylidene diphenyl carbonate) modified by including a small fraction of polydimethyl siloxane (PDMS) linkages in the main polycarbonate chain back bone to obtain Formula (1) below:

Formula (I)

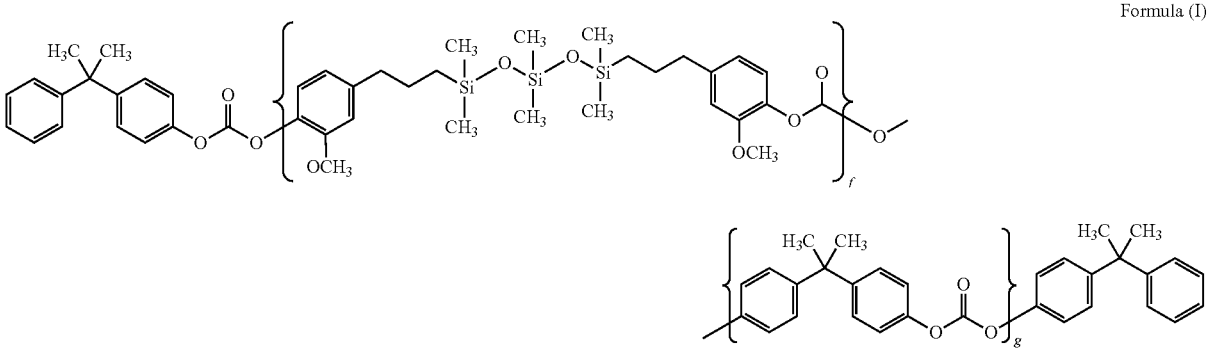

wherein x is a number from about 10 and about 50 while f and g are numbers representing the respective repeating units such that f is between about 1 and about 4 and g is from about 10 to about 100 determined for a weight average molecular weight of from about 15,000 to about 130,000 of the low surface energy polycarbonate, a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (2) below:

Formula (2)

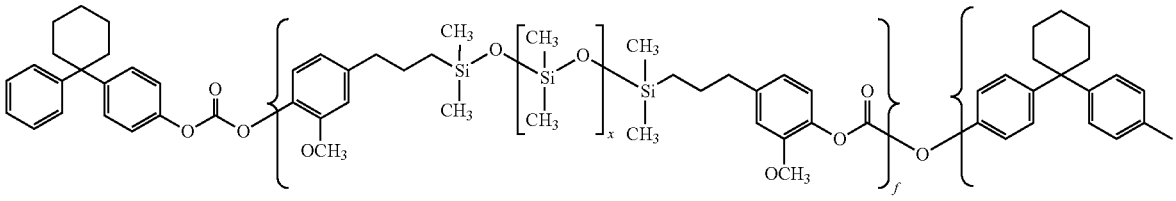

-continued

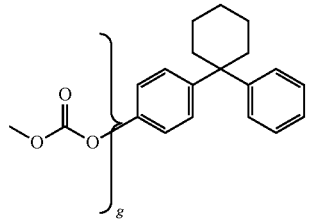

wherein x is a number from about 10 and about 50 while f and g are numbers representing the respective repeating units such that f is between about 1 and about 4 and g is from about 10 to about 100 determined for a weight average molecular weight of from about 15,000 to about 130,000 of the low surface energy polycarbonate, a bisphenol C polycarbonate of poly(4,4'-isopropylidene diphenyl carbonate) modified by including a small fraction of polydimethyl siloxane (PDMS) linkages into the main polycarbonate chain back bone to obtain Formula (3) below:

Formula (3)

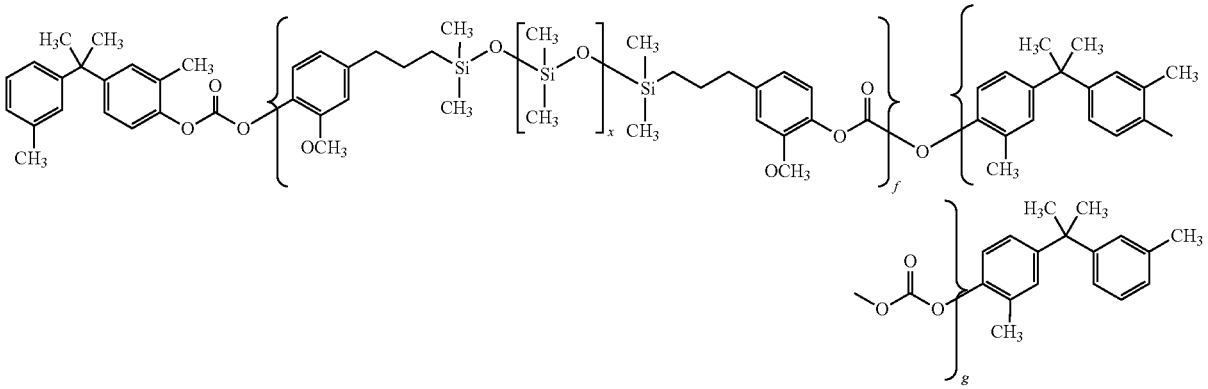

wherein x is a number from about 10 and about 50 while f and g are numbers representing the respective repeating units such that f is between about 1 and about 4 and g is from about 10 to about 100 determined for a weight average molecular weight of from about 15,000 to about 130,000 of the low surface energy polycarbonate, and a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (4) below:

Formula (4)

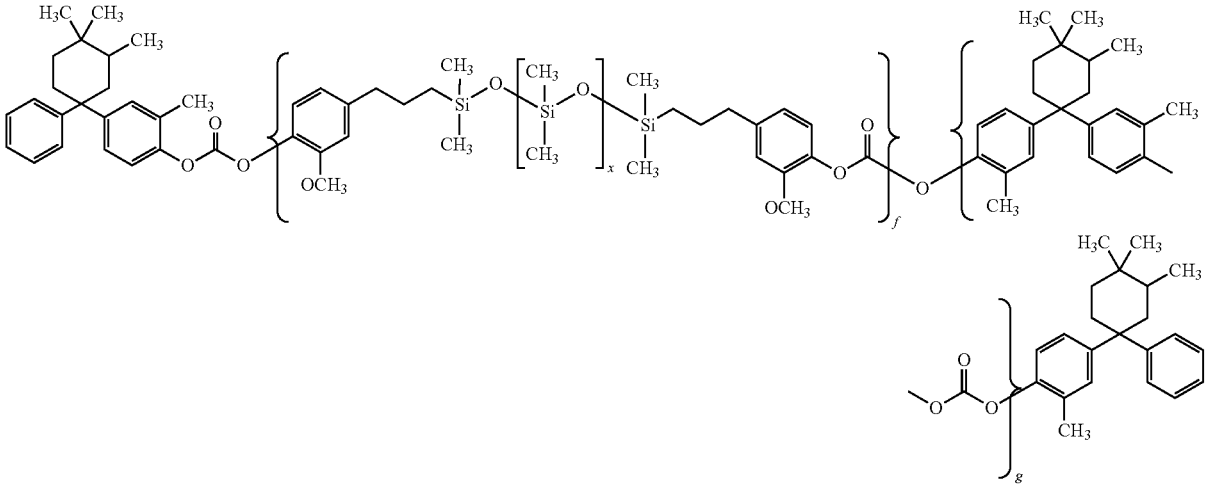

wherein x is a number from about 10 and about 50 while fang are numbers representing the respective repeating units such that f is between about 1 and about 4 and g is from about 10 to about 100 determined for a weight average molecular weight of from about 15,000 to about 130,000 of the low surface energy polycarbonate, and mixtures thereof; and an anticurl back coating layer disposed on the flexible substrate on a side opposite the charge generating and charge transport layers.

In yet other embodiments, there is provided an image forming apparatus for forming images on a recording medium comprising: a) an imaging member having a charge retentive-surface for receiving an electrostatic latent image thereon, wherein the imaging member comprises a flexible substrate, a charge generating layer disposed on the substrate, at least one charge transport layer disposed on the charge generating layer, and an overcoat layer disposed over the at least one charge transport layer, wherein the overcoat layer comprises a blend of a polycarbonate binder and a low surface energy polycarbonate, and further wherein the polycarbonate binder is an A-B diblock copolymer comprising a bisphenol A polycarbonate segment block (A) and a phthalic acid containing segment block (B) terminal capable of providing protection against amine species contaminants, selected from the group consisting of Formula (I) and Formula (II) below:

Formula (I)

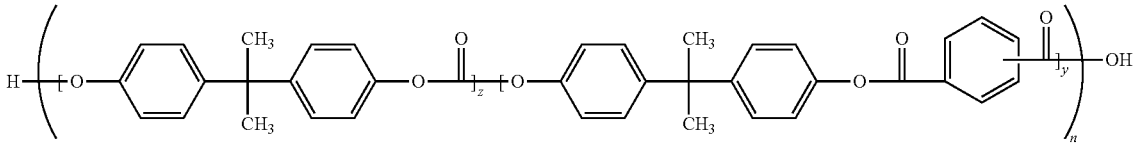

Block (A) Block (B)

Formula (II)

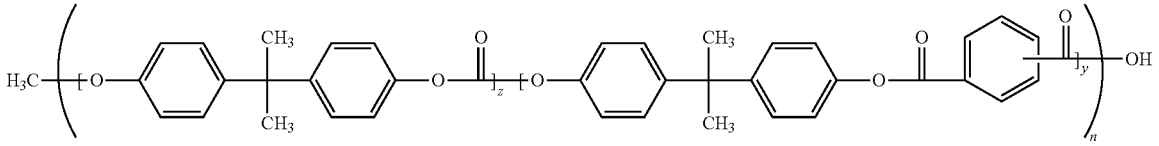

Block (A) Block (B)

wherein z represents the number of bisphenol A repeating units in block A of from about 9 to about 18, y is number of repeating phthalic acid block B of from about 1 to about 2, and n is the degree of polymerization between about 20 and about 80 for the copolymer having a weight average molecular weight between about 100,000 and about 200,000, and mixtures thereof, while the low surface energy polycarbonate is selected from the group consisting of a bisphenol A polycarbonate of poly(4,4'-isopropylidene diphenyl carbonate) modified by including a small fraction of polydimethyl siloxane (PDMS) linkages in the main polycarbonate chain back bone to obtain Formula (1) below:

Formula (I)

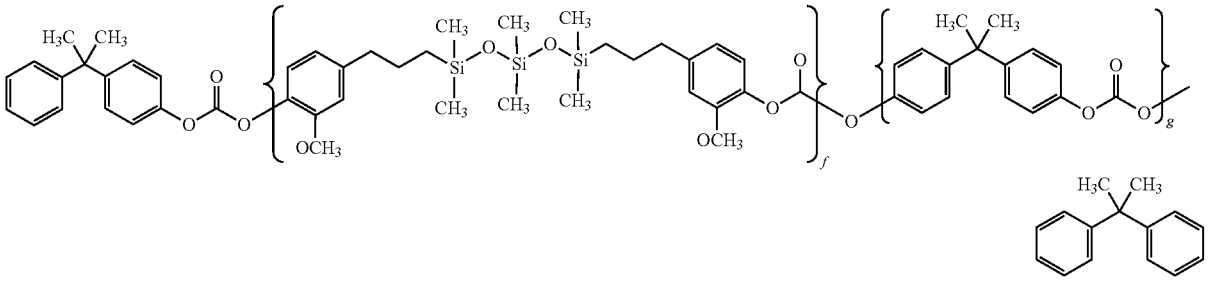

wherein x is a number from about 10 to about 50, and f and g are numbers representing each respective repeating segment such that f is from about 1 to about 4 and g is from about 10 to about 100 determined for a molecular weight of from about 15,000 to about 130,000 of the low surface energy polycarbonate, a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (2) below:

Formula (2)

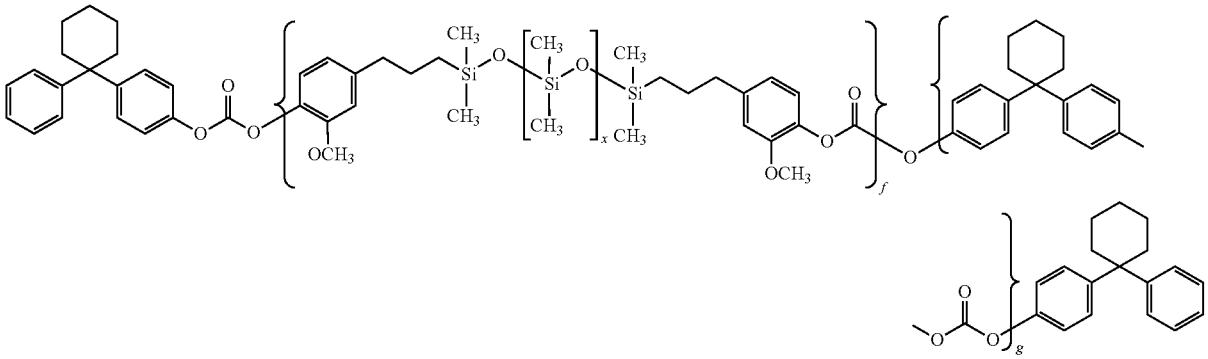

wherein x is a number from about 10 and about 50 while f and g are numbers representing each respective repeating units such that f is between about 1 and about 4 and g is from about 10 to about 100 determined for a weight average molecular weight of from about 15,000 to about 130,000 of the low surface energy polycarbonate, a bisphenol C polycarbonate of poly(4,4'-isopropylidene diphenyl carbonate) modified by including a small fraction of polydimethyl siloxane (PDMS) linkages into the main polycarbonate chain back bone to obtain Formula (3) below:

Formula (3)

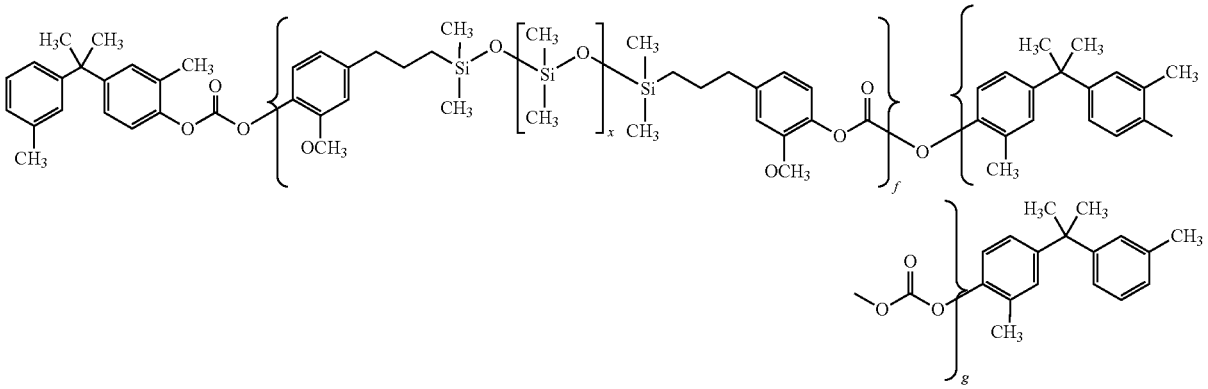

wherein x is a number from about 10 and about 50 while f and g are numbers representing the respective repeating units such that f is between about 1 and about 4 and g is from about 10 to about 100 determined for a weight average molecular weight of from about 15,000 to about 130,000 of the low surface energy polycarbonate, and a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (4) below:

Formula (4)

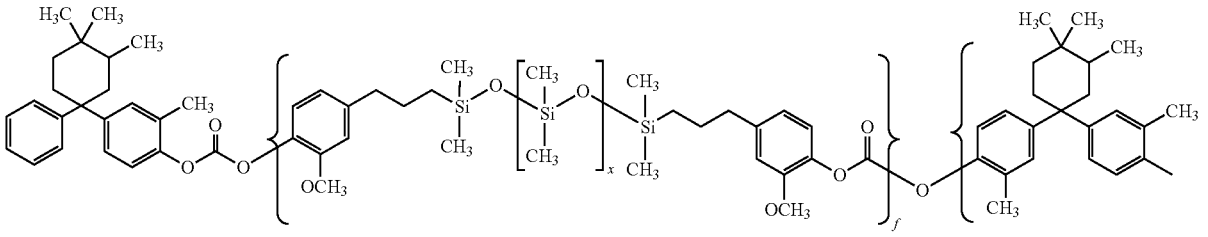

-continued

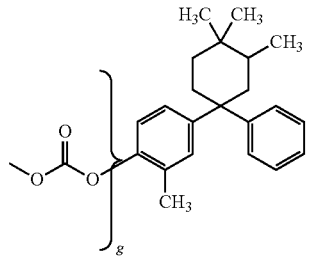

wherein x is a number from about 1.0 and about 50 while f and g are numbers representing the respective repeating units such that f is between about 1 and about 4 and g is from about 10 to about 100 determined for a weight average molecular weight of from about 15,000 to about 130,000 of the low surface energy polycarbonate, and mixtures thereof; and an anticurl back coating layer disposed on the flexible substrate on a side opposite the charge generating and charge transport layers; b) a development component for applying a developer material to the charge-retentive surface to develop the electrostatic latent image to form a developed image on the charge-retentive surface; c) a transfer component for transferring the developed image from the charge-retentive surface to a copy substrate; and d) a fusing component for fusing the developed image to the copy substrate.

BRIEF DESCRIPTION OF THE DRAWINGS

For a better understanding of the present disclosure, reference may be made to the accompanying figures.

DETAILED DESCRIPTION

Figure 1:
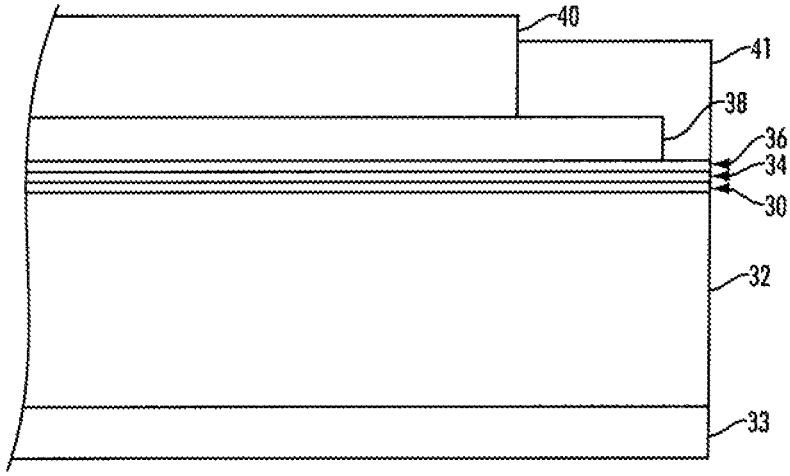
FIG. 1 a cross-sectional view of a conventional flexible multilayered electrophotographic imaging member having an outermost exposed charge transport layer.

In the following description, reference is made to the accompanying drawings, which form a part hereof and which illustrate several embodiments. It is understood that other embodiments may be utilized and structural and operational changes may be made without departure from the scope of the present embodiments.

According to aspects illustrated herein, there is provided a negatively charged flexible multilayered electrophotographic imaging members prepared to include an improved overcoat layer. This flexible imaging member is prepared to comprise a flexible substrate, a charge generating layer disposed on the substrate, charge transport layer, a protective overcoat layer having lubricated surface and chemical resistivity added onto the charge transport layer, and an anticurl back coating to render imaging member flatness. Chemical resistivity is defined as the capability of the overcoat to neutralize chemical species deposited onto the imaging member surface under machine electrophotographic imaging function conditions in the field. An anticurl back coating is also applied to the back side of the substrate opposite to the side having the electrically active layers to render imaging member flatness. The process and formulations of the disclosed overcoat relate generally to the creation of a mechanically robust and chemical resistive protective overcoat layer to: (1) render surface slipperiness to effect contact friction reduction for achieving wear/scratch/filming resistant enhancement; (2) impart quenching/neutralization capability against chemical contaminant attack; (3) resist fatigue surface cracking for service life extension; and (4) have absolute optical clarity for image quality/sharpness improvement in print out copies. The imaging member prepared according to the present disclosure thereby improves mechanical function and copy printout quality under normal machine operation conditions in the field.

In the example of one specific flexible, negatively charged electrophotographic imaging member, there is provided a flexible substrate, a charge generating layer disposed on one side of the substrate; at least one charge transport layer disposed onto the charge generating layer, an outermost exposed top overcoat layer, and an anticurl back coating disposed on the opposite side of the substrate to balance the curl and render the imaging member with proper flatness. The outermost exposed top overcoat layer of the present disclosure, applied directly over the charge transport layer, has an effective slippery surface formulated to comprise a binary polymer blend consisting of blending a novel film forming A-B diblock copolymer and a film forming low surface energy polycarbonate polymer. The weight ratio of the diblock copolymer to the low surface energy polycarbonate is between about 5:95 and about 95:5, based on the total weight of the formulated polymer blended overcoat of this disclosure.

The diblock copolymer is a derivation from modifying the bisphenol A polycarbonate poly(4,4'-isopropylidene diphenyl carbonate) to include a phthalic acid containing linkage in the copolymer chain back bone. Therefore, the A-B diblock copolymer comprises a bisphenol A polycarbonate segment block (A) and a phthalic acid containing segment block (B) terminal, having the general molecular structures shown in Formula (I) below:

Formula (I)

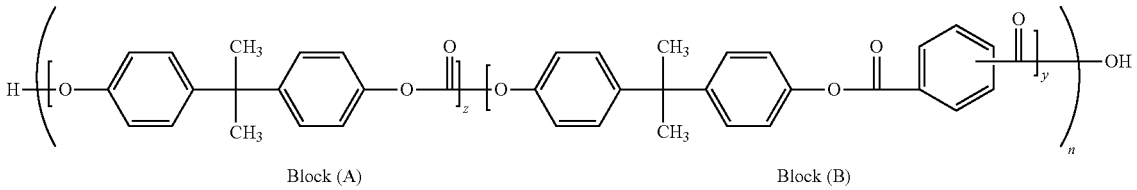

where z represents the number of bisphenol A repeating units in block A of from about 9 to about 18, y is number of repeating phthalic acid block B of from about 1 to about 2, and n is the degree of polymerization. The degree of polymerization, n, is between about 20 and about 80 of the diblock copolymer having a weight average molecular weight between about 100,000 and about 200,000. The phthalic acid presence in each A-B diblock copolymer molecule terminal has the capability to provide an amine quenching/neutralization effect, through acid-base reaction, to resolve the current pre-printed papers ghosting defects issue observed in the xerographic printout copies.

Likewise, the film forming low surface energy polycarbonate used for formulating the overcoat layer polymer blending, is also derived from the modification of a bisphenol A polycarbonate of poly(4,4'-isopropylidene diphenyl carbonate) by the inclusion of a small fraction of polydimethyl siloxane (PDMS) linkages in the main polycarbonate chain back bone. In embodiments, a small fraction is defined as having between about 2 and about 10 weight percent of the PDMS linkages present the main polycarbonate chain back hone based on the molecular weight of the low surface energy polycarbonate. The PDMS containing bisphenol A polycarbonate as obtained has the following Formula (1):

Formula (1)

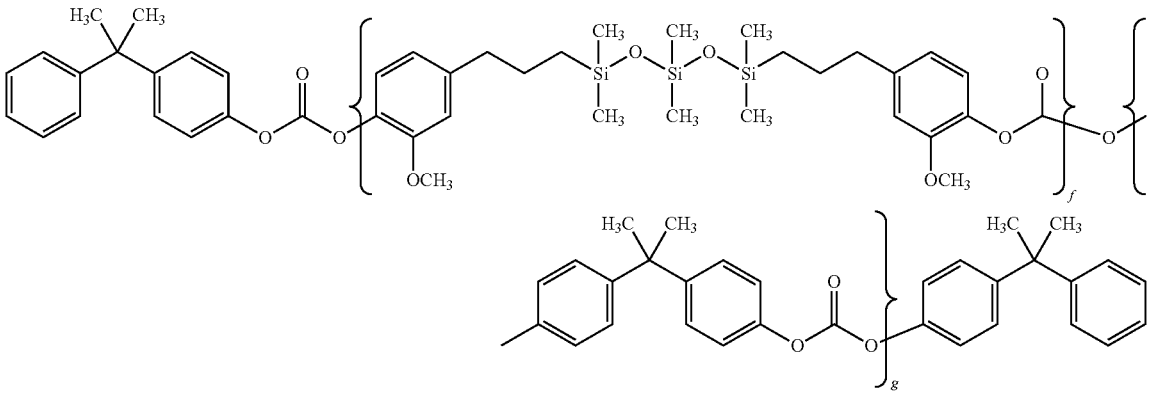

where x is a number between about 10 and about 50, while f and g are numbers representing a number of each respective repeating segments. In embodiments, f is from about 1 to about 4 and g is from about 10 to about 100 determined for a weight average molecular weight of from about 15,000 to about 130,000 of the low surface energy polycarbonate.

In another specific flexible, negatively charged electrophotographic imaging member, the disclosed overcoat applied directly over the charge transport layer is repeatedly formulated in the exact same manners as described above. So, the overcoat prepared is again comprised of a binary polymer blend consisting of blending a novel film forming A-B diblock copolymer and the same film forming low surface energy polycarbonate polymer of Formula (1). The film forming A-B diblock copolymer used is, likewise, comprising the same bisphenol A polycarbonate poly(4,4'-isopropylidene diphenyl carbonate) block (A) and a phthalic acid containing terminal segmental block (B), but with the only exception that the end terminal of the bisphenol A polycarbonate segment block (A) is terminated with a methy, —$CH_3$ group. Thus, in this A-B diblock copolymer, the molecular structure becomes Formula (II):

Formula (II)

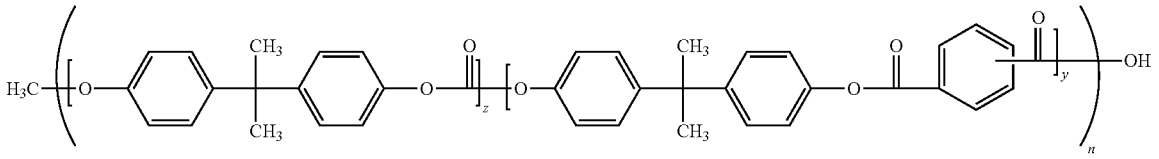

Block (A) Block (B)

In the alternative embodiments, the disclosed overcoat applied directly over the charge transport layer is reformulated to comprise the A-B diblock copolymer of Formulas (1) and (II) plus the incorporation of between about 0.05 to about 1.0 weight percent a liquid slip agent based on the resulting weight of the slippery overcoat. The slip agent selected for use has a molecular formula shown below:

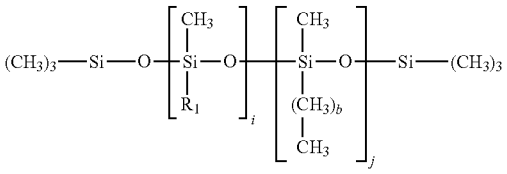

wherein i and j are between about 5 and about 50, b is a number between 0 and 10, and $R_1$ is as defined below.

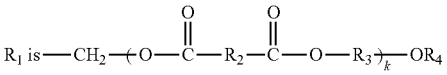

wherein k is a number between about 1 and about 30, $R_2$ and $R_3$ are alkylene groups containing from 1 to 10 carbon atoms, and $R_4$ is a hydrogen atom or an alkyl group containing 1 to 3 carbon atoms.

In another alternative embodiments, the disclosed overcoat applied directly over the charge transport layer is reformulated to comprise the A-B diblock copolymer of Formulas (1) and (II), and a dispersion of nanoparticles of polyhedral oligomeric silsesquioxane (POSS) in the overcoat material matrix. POSS is nanoscopic size particles of chemical structured hybrid intermediate between that of a silica and silicones. As it is nanostructured in size, ranging from about 1 to about 3 nanometers, the dispersion of POSS in the copolymer binder matrix to form a nanocomposite layer has been used to yield reinforcement to impact physical and mechanical robust function. To effect overcoat surface slipperiness, the present disclosure has shown that incorporation of from about 1 to about 10 weight percent of a particularly selected POSS, for example, those containing a low surface energy pendant side group of polysiloxane (PDMS) and polytetrafluoroethylene (PTFE), based on the total weight of the prepared overcoat, is adequate to produce the desired outcome.

In all of the above embodiments, the charge transport layer of the imaging members is covered and protected with the added-on outermost overcoat layer which is formulated and prepared according to the material formulation and process of the present disclosure; it is very effective to provide charge transport layer protection against mechanical failure and chemical attack for achieving imaging members functional life extension objective in the in the field.

For reference, a typical conventional negatively charged flexible electrophotographic imaging member is illustrated in FIG. 1. The substrate 32 has an optional conductive layer 30. An optional hole blocking layer 34 disposed onto the conductive layer 30 is coated over with an optional adhesive layer 36. The charge generating layer (CGL) 38 is located between the adhesive layer 36 and the outermost exposed charge transport layer (CTL) 40. An optional ground strip layer 41, coated at one edge of the imaging member, operatively connects the CGL 38 and the CTL 40 to the conductive ground plane 30. An anti-curl backing layer 33 is applied to the side of the substrate 32 opposite from the side containing all the electrically active layers to render imaging member flatness and give complete imaging member structure.

The Substrate

The imaging member support substrate 32 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The substrate 32 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate 32 the substrate may have a number of many different configurations, such as, for example, a plate, a drum, a scroll, an endless flexible belt, and the like. In one embodiment, the substrate is in the form of a seamed flexible belt.

The thickness of the substrate 32 depends on numerous factors, including flexibility, mechanical performance, and economic considerations. The thickness of the support substrate 32 may range from about 50 micrometers to about 3,000 micrometers. In embodiments of flexible photoreceptor belt preparation, the thickness of substrate 32 is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers.

An exemplary substrate support 32 is not soluble in any of the solvents used in each coating layer solution, is optically transparent, and is thermally stable up to a high temperature of about 150° C. A typical substrate support 32 used for imaging member fabrication has a thermal contraction coefficient ranging from about $1\times10^{-5}$/° C. to about $3\times10^{-5}$/° C. and a Young's Modulus of from about $5\times10^{-5}$ psi ($3.5\times10^{-4}$ Kg/cm$^2$) to about $7\times10^{-5}$ psi ($4.9\times10^{-4}$ Kg/cm$^2$).

The Conductive Layer

The conductive ground plane layer 30 may vary in thickness depending on the optical transparency and flexibility desired for the electrophotographic imaging member. When a photoreceptor flexible belt is desired, the thickness of the conductive layer 30 on the support substrate 32, for example, a titanium and/or zirconium conductive layer produced by a sputtered deposition process, typically ranges from about 2 nanometers to about 75 nanometers to enable adequate light transmission for proper back erase, and in embodiments from about 10 nanometers to about 20 nanometers, for an optimum combination of electrical conductivity, flexibility, and light transmission. Generally, for rear erase exposure, a conductive layer light transparency of at least about 15 percent is desirable. The conductive layer need not be limited to metals. The conductive layer 30 may be an electrically conductive metal layer which may be formed, for example, on the substrate by any suitable coating technique, such as a vacuum depositing or sputtering technique. Typical metals suitable for use as conductive layer 30 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface thereof can perform the function of an electrically conductive layer and a separate electrical conductive layer may be omitted. Other examples of conductive layers may be combinations of materials such as conductive indium tin oxide as a transparent layer for light having a wavelength from about 4000 Angstroms to about 9000 Angstroms or a conductive carbon black dispersed in a plastic binder as an opaque conductive layer.

The illustrated embodiment will be described in terms of a substrate layer 10 comprising an insulating material including inorganic or organic polymeric materials, such as, MYLAR with a ground plane layer 30 comprising an electrically conductive material, such as titanium or titanium/zirconium, coating over the substrate layer 32.

The Hole Blocking Layer

A hole blocking layer 34 may then be applied to the substrate 32 or to the layer 30, where present. Any suitable positive charge (hole) blocking layer capable of forming an effective barrier to the injection of holes from the adjacent conductive layer 30 into the photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula $[H_2N(CH_2)_4]CH_3Si(OC_{H3})_2$, and (gamma-aminopropyl)methyl diethoxysilane, which has the formula $[H_2N(CH_2)_3]CH_{33}Si(OCH_3)_2$, and combinations thereof, as disclosed, for example, in U.S. Pat. Nos. 4,338,387; 4,286,033; and 4,291,110, incorporated herein by reference in their entireties. A preferred hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The hole blocking layer 34 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of from about 0.05:100 to about 5:100 is satisfactory for spray coating.

The Adhesive Interface Layer

An optional separate adhesive interface layer 36 may be provided. In the embodiment illustrated in FIG. 1, an interface layer 36 is situated intermediate the blocking layer 34 and the charge generator layer 38. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 36 may be applied directly to the hole blocking layer 34. Thus, the adhesive interface layer 36 in embodiments is in direct contiguous contact with both the underlying hole blocking layer 34 and the overlying charge generator layer 38 to enhance adhesion bonding to provide linkage. In yet other embodiments, the adhesive interface layer 36 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 36 may have a thickness of from about 0.01 micrometers to about 900 micrometers after drying. In embodiments, the dried thickness is from about 0.03 micrometers to about 1 micrometer.

The Charge Generating Layer

The photogenerating layer, CGL 38 may thereafter be applied to the adhesive layer 36. Any suitable charge generating binder layer 38 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength from about 400 to about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the CGL 38, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a $M_W$=40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The CGL 38 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Charge Transport Layer

The CTL 40 is thereafter applied over the charge generating layer 38 and may include any suitable transparent organic polymer or non-polymeric material capable of supporting the injection of photogenerated holes or electrons from the charge generating layer 38 and capable of allowing the transport of these holes/electrons through the CTL to selectively discharge the surface charge on the imaging member surface. In one embodiment, the CTL 40 not only serves to transport holes, but also protects the charge generating layer 38 from abrasion or chemical attack and may therefore extend the service life of the imaging member. The CTL 40 can be a substantially non-photoconductive material, but one which supports the injection of photogenerated holes from the charge generation layer 18. The layer 40 is normally transparent in a wavelength region in which the electrophotographic imaging member is to be used when exposure is effected there-through to ensure that most of the incident radiation is utilized by the underlying charge generating layer 38. The CTL should exhibit excellent optical transparency with negligible light absorption and neither charge generation nor discharge if any, when exposed to a wavelength of light useful in xerography, e.g., 400 to 900 nanometers. In the case when the photoreceptor is prepared with the use of a transparent substrate 32 and also a transparent conductive layer 30, image wise exposure or erase may be accomplished through the substrate 32 with all light passing through the back side of the substrate. In this case, the materials of the layer 40 need not transmit light in the wavelength region of use if the charge generating layer 38 is sandwiched between the substrate and the CTL 40. The CTL 40 in conjunction with the charge generating layer 38 is an insulator to the extent that an electrostatic charge placed on the CTL is not conducted in the absence of illumination. The CTL 40 should trap minimal charges as the charge pass through it during the printing process.

The CTL 40 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 38 and capable of allowing the transport of these holes through the CTL 40 in order to discharge the surface charge on the CTL. The charge transport component typically comprises small molecules of an organic compound which cooperate to transport charge between molecules and ultimately to the surface of the CTL.

Any suitable inactive resin binder soluble in methylene chloride, chlorobenzene, or other suitable solvent may be employed in the CTL. Exemplary binders include polyesters, polyvinyl butyrals, polycarbonates, polystyrene, polyvinyl formals, and combinations thereof. The polymer binder used for the CTLs may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly(4,4'-isopropylidene diphenyl carbonate), poly(4,4'-diphenyl-1,1'-cyclohexane carbonate), and combinations thereof. The molecular weight of the binder can be for example, from about 20,000 to about 1,500,000. One exemplary binder of this type is a MAKROLON binder, which is available from Bayer AG and comprises poly(4,4'-isopropylidene diphenyl) carbonate having a weight average molecular weight of about 120,000.

Exemplary charge transport components include aromatic polyamines, such as aryl diamines and aryl triamines. Exemplary aromatic diamines include N,N'-diphenyl-N,N'-bis(alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16). N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in layer 40 may be, for example, at least about 5 weight percent and may comprise up to about 60 weight percent. The concentration or composition of the charge transport component may vary through layer 40, as disclosed, for example, in U.S. Pat. Nos. 7,033,714; 6,933,089; and 7,018,756, the disclosures of which incorporated herein by reference in their entireties.

In one exemplary embodiment, layer 40 comprises an average of about 10-60 weight percent N,N'-diphenyl-N,N'-bis(3-methylphenyl)-1,1'-biphenyl-4,4'-diamine, such as from about 30-50 weight percent N,N'-diphenyl-N,N'-bis(3-methylphenyl)-1,1'-biphenyl-4,4'-diamine.

The CTL 40 is an insulator to the extent that the electrostatic charge placed on the CTL is not conducted in the absence of illumination at a rate sufficient to prevent formation and retention of an electrostatic latent image thereon. In general, the ratio of the thickness of the CTL 40 to the charge generator layer 38 is maintained from about 2:1 to about 200:1 and in some instances as great as about 400:1.

Additional aspects relate to the inclusion in the CTL 40 of variable amounts of an antioxidant, such as a hindered phenol. Exemplary hindered phenols include octadecyl-3,5-di-tert-butyl-4-hydroxyhydrocinnamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. Pat. No. 7,018,756, incorporated by reference.

In one specific embodiment, the CTL 40 is a solid solution including a charge transport component, such as N,N'-diphenyl-N,N'-bis(3-methylphenyl)-1,1'-biphenyl-4,4'-diamine, molecularly dissolved in a polycarbonate binder, the binder that is frequently being used is either a bisphenol A polycarbonate of poly(4,4'-isopropylidene diphenyl carbonate) or a bisphenol Z polycarbonate of poly(4,4'-diphenyl-1,1'-cyclohexane carbonate).

Bisphenol A is a chemical building block primarily used to make polycarbonate plastic and epoxy resins. The film forming bisphenol A polycarbonate, having a weight average molecular weight of from about 20,000 to about 130,000 is typically used as the CTL binder: it has a molecular structure formula shown below:

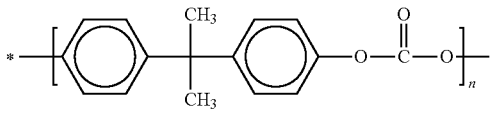

where n indicates the degree of polymerization. Alternatively, the bisphenol Z polycarbonate of poly(4,4'-diphenyl-1,1'-cyclohexane carbonate) may also be used to for binder the CTL formulation. The molecular structure of poly(4,4'-diphenyl-1,1'-cyclohexane carbonate), having a weight average molecular weight of about from about 20,000 to about 200,000, is given in the formula below:

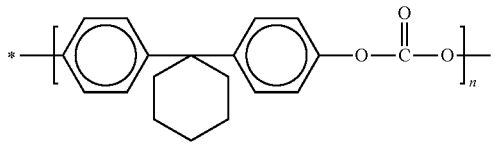

where n indicates the degree of polymerization.

The conventional CTL 40 may have a Young's Modulus in the range of from about $2.5\times10^{-5}$ psi ($1.7\times10^{-4}$ Kg/cm$^2$) to about $4.5\times10^{-5}$ psi ($3.2\times10^{-4}$ Kg/cm$^2$) and a thermal contraction coefficient of from about $6\times10^{-5}$/° C. to about $8\times10^{-5}$/° C.

The thickness of the CTL 40 can be from about 5 micrometers to about 200 micrometers and preferably from about 15 micrometers to about 40 micrometers. The CTL may comprise dual layers or multiple layers with different concentration of charge transporting components.

The Ground Strip layer

Other layers such as conventional ground strip layer 41 is conveniently applied by co-coating process along with the application of CTL and adjacent to one edge of the imaging member. A typical ground strip layer 41 does include, for example, conductive particles dispersed in a film forming binder may be applied to one edge of the imaging member to promote electrical continuity with the conductive layer 30 through the hole blocking layer 34. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer may have a thickness from about 7 micrometers to about 42 micrometers, for example, from about 14 micrometers to about 23 micrometers.

The Anticurl Back Coating

Since the CTL 40 can have a substantial thermal contraction mismatch compared to that of the substrate support 32, the prepared flexible electrophotographic imaging member may exhibit spontaneous upward curling due to the result of larger dimensional contraction in the CTL than the substrate support 32, as the imaging member cools down from its Tg to room ambient temperature after the heating/drying processes of the applied wet CTL coating. An anti-curl back coating 33 can be applied to the back side of the substrate support 32 (which is the side opposite the side bearing the electrically active coating layers) in order to render the prepared imaging member with desired flatness.

Generally, anticurl back coating 33 comprises a polymer and an adhesion promoter dissolved in a solvent and coated on the reverse side of the active photoreceptor. The anticurl back coating must adhere well to the substrate 32, for example polyethylenenaphthalate (KADELEX) substrate, of the imaging member, for the entire duration of the functional life of the imaging member belt, while being subjected to xerographic cycling over rollers and backer bars within the copier or printer.

In a typical anticurl back coating, film forming bisphenol A polycarbonate or bisphenol Z polycarbonate, same as the binder polymer used in the CTL 40, is also used for anticurl back coating preparation. To promote adhesion bonding to the substrate support 33, an adhesion promoter of copolyester is included in its material matrix to effect the anticurl back coating adhesion strength to the substrate support. Satisfactory adhesion promoter content is from about 0.2 percent to about 20 percent but preferably from about 2 percent to about 10 percent by weight, based on the total weight of the anticurl back coating The adhesion promoter may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol. A solvent such as methylene chloride may be used in embodiments. The anticurl back coating has a thickness of from about 5 micrometers to about 50 micrometers, but preferably from about 10 micrometers to about 20 micrometers, in further embodiments. A generic or conventional anticurl back coating formulation is a 92:8 ratio of polymer to adhesive dissolved at 9 percent by weight in a solvent. Specifically, the formulation may be 92:8 ratio of polycarbonate to VITEL PE2200 adhesive. The polycarbonate and adhesive promoter may both be dissolved at 9 percent by weight in a solvent of methylene chloride to give the anticurl back coating solution.

Figure 2:
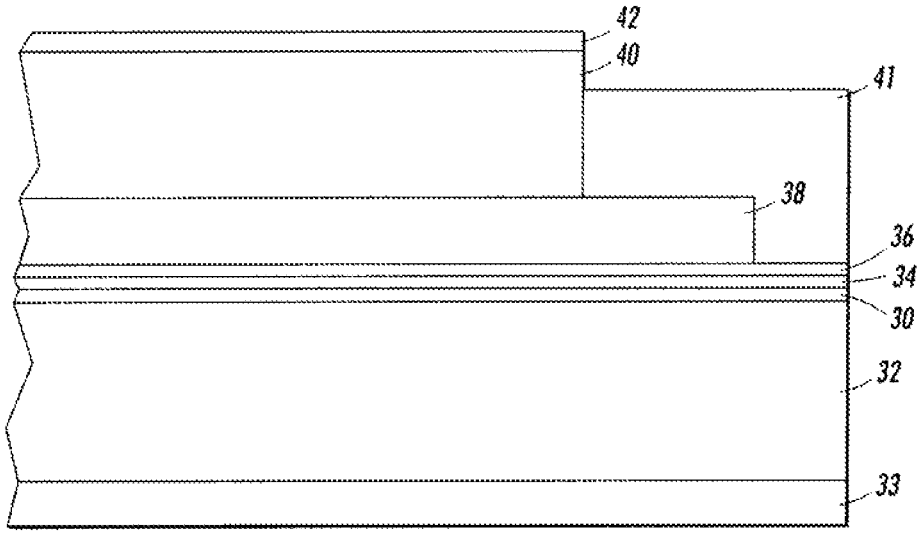
FIG. 2 is a cross-sectional view of a flexible multilayered electrophotographic imaging member comprising an improved overcoat layer according to the present embodiments.

The flexible multilayered electrophotographic imaging member of an exemplified embodiment of the present disclosure is shown in FIG. 2. Although all the photoelectrically active layers 30, 32, 33, 34, 36, 38, 40, 41 in this imaging member are prepared and maintained to comprise of the very exact same compositions and dimensions as those described in FIG. 1, nonetheless the exception is that an overcoat layer 42 is added onto the CTL 40 to effect surface contact friction reduction, provide protection against chemical contaminant attack, and improve mechanical function.

The Overcoat Layer

The present embodiments provide an imaging member including a physically, mechanically, and chemically robust overcoat 42, applied directly over the CTL 40 of the imaging member, to effect surface protection against chemical contaminant attack and improve mechanical function for achieving service life extension in the field. Therefore, the overcoat layer 42 prepared according to the present formulation disclosure is intended to impact effective protection for the CTL against abrasion/scratch/wear failures as a result of constant mechanical interaction against cleaning blade, cleaning brush, dirt debris, carrier beads from developer, and loose $CaCO_3$ particles from paper. Most importantly, the elimination of chemical amine attack from pre-printed papers that exacerbates the early onset of print quality failure extends the service life of the imaging member.

In the example of one specific flexible multilayered electrophotographic imaging member, the overcoat layer 42 of the present disclosure, applied directly over the charge transport layer, is formulated to comprise a binary polymer blend consisting of blending a novel film forming A-B diblock copolymer and a film forming low surface energy polycarbonate polymer. The diblock copolymer is a derivation from modifying the bisphenol A polycarbonate poly(4,4'-isopropylidene diphenyl carbonate) to include a phthalic acid containing linkage in the copolymer chain back bone. Therefore, the A-B diblock copolymer is comprising of a bisphenol A polycarbonate segment block (A) and a phthalic acid containing segment block (B) terminal, having the general molecular structures shown in Formula (I) below:

Formula (I)

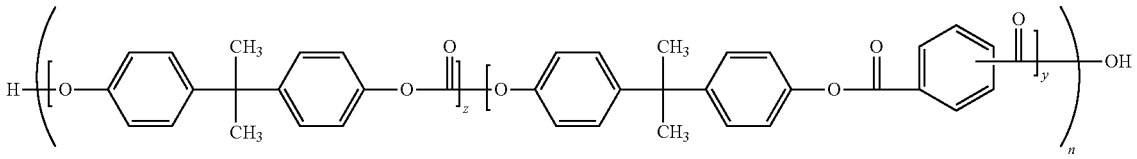

Block (A) Block (B)

where z represents the number of bisphenol A repeating units in block A of from about 9 to about 18, y is number of repeating phthalic acid block B of from about 1 to about 2, and n is the degree of polymerization. The degree of polymerization, n, is between about 20 and about 80 of the A-B diblock copolymer having a weight average molecular weight between about 100,000 and about 200,000. The phthalic acid presence in each A-B diblock copolymer molecule terminal has the capability to provide an amine quenching/neutralization effect, through acid-base reaction, to resolve the current pre-printed papers ghosting defects issue observed in the xerographic printout copies.

And likewise, the film forming low surface energy polycarbonate selected for used in binary polymer blending to form the overcoat, is also derived from the modification of a bisphenol A polycarbonate of poly(4,4'-isopropylidene diphenyl carbonate):

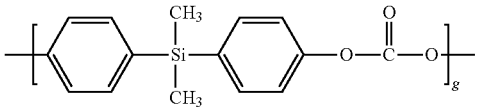

by linearly linking of small fraction of polydimethyl siloxane (PDMS) containing segments of

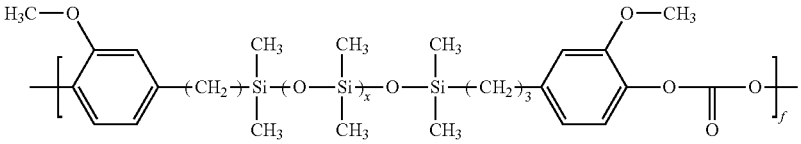

into the main polycarbonate chain back bone to give a low surface energy modified bisphenol A polycarbonate. Therefore, the resulting PDMS containing low surface energy polycarbonate as obtained has the following Formula (1):

Formula (1)

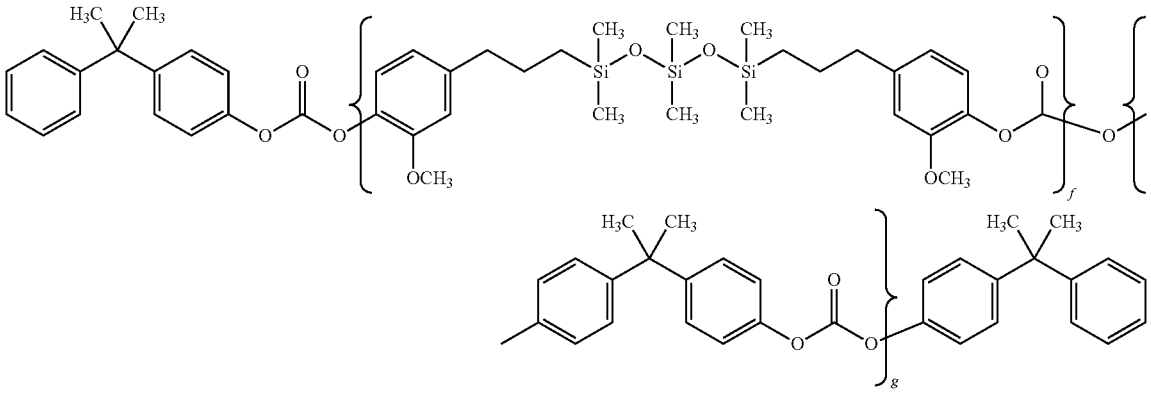

wherein x to is the number of PDMS units, ranging from about 10 to about 50, f is number of PDMS containing segments of from about 1 to about 4 calculated based on from about 2 to about 10 weight percent of the molecular weight of the low surface energy polycarbonate, and g is the numbers of repeating bisphenol A polycarbonate of poly(4,4'-isopropylidene diphenyl carbonate) segments in the main low surface energy polycarbonate chain backbone to give values of from about 10 and about 100, as determined for a weight average molecular weight of from about 15,000 to about 130,000 of the low surface energy polycarbonate.

In another specific flexible multilayered electrophotographic imaging member, the overcoat layer 42 of the present disclosure is repeatedly formulated in the exact same manners as those described above. The prepared overcoat again is comprised of a binary polymer blend consisting of blending a novel film forming A-B diblock copolymer and the same film forming low surface energy polycarbonate polymer of Formula (1). Although the film forming A-B diblock copolymer used is likewise consisting of a bisphenol A polycarbonate poly(4,4'-isopropylidene diphenyl carbonate) block (A) and a phthalic acid containing terminal segmental block (B), but with the exception that the terminal end of the bisphenol A polycarbonate segment block (B) is terminated with a methy, —$CH_3$, group. So, in this A-B diblock copolymer, the molecular structure of Formula (I) does then become Formula (II):

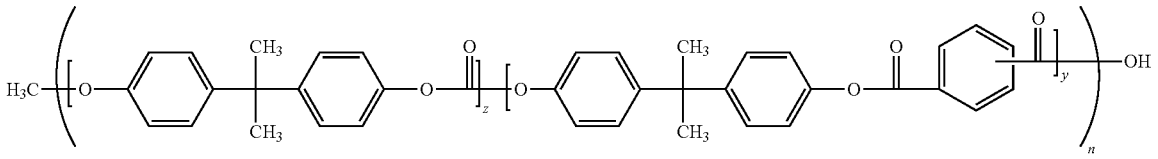

Formula (II)

In both above embodiments, the charge transport layer of the imaging members is covered and protected with the outermost polymer blended overcoat layer 42 which is formulated and prepared to have a thickness of from about 1 to about 10 micrometers or from about 2 to about 6 micrometers. The prepared overcoat has slippery surface and comprises a weight ratio of diblock copolymer to low surface energy polycarbonate of between about 5:95 and about 95:5 and may also include a diamine charge transport compound N,N'-diphenyl-N,N'-bis(3-methylphenyl)-1,1'-biphenyl-4,4'-diamine of from about 0 to about 10 weight percent based on the total weight of the prepared overcoat 42.

The specific A-B diblock copolymer chosen to meet the present overcoat polymer blend formulation requirement is LEXAN HLX polymer available from Sable Innovative Plastics. Since the LEXAN HLX (as described in the above Formulas (I) and (II)) is a bisphenol A polycarbonate/phthalic acid film forming copolymer. The key benefits of choosing LEXAN HLX polymer are based on: (a) compatibility with the chosen low surface energy polycarbonate to form a homogeneous polymer blended overcoat layer; and (b) capability of the phthalic acid terminal in the copolymer to effect amine species quenching/neutralization outcome for absolute elimination of the root cause of copy ghosting defects printout problem. Since the novel film forming A-B diblock copolymer, being a polycarbonate, is derived/modified from bisphenol A polycarbonate structure by the inclusion of small fraction of phthalic acid into the polymer backbone, the resulting copolymer contains about 90 mole percent of a bisphenol A segment block (A) linearly linking to about 10 mole percent of a segmental block (B) of phthalic acid terminal in the A-B diblock copolymer chain. However, to extend present disclosure coverage of using the A-B diblock copolymer for curl free imaging member preparation, the copolymer used for charge transport layer formulation may further include structural variances of the A-B diblock copolymer of Formulas (I) and (II), through the replacement of the bisphenol A segmental block (A) in the copolymer by each of the following types of carbonates selected to consist of:

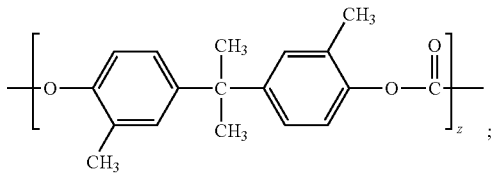

-continued

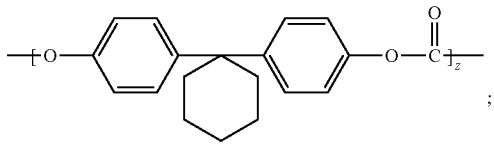

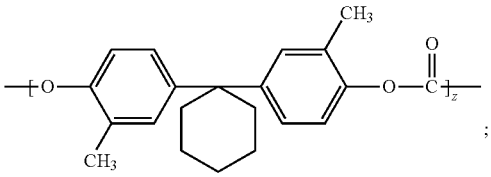

; and

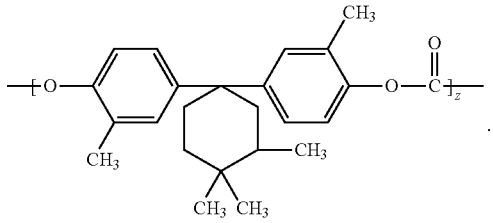

In the further extended embodiments of this disclosure shown in FIG. 2, the phthalic acid terminal block (B) linkage in the A-B diblock copolymer molecule of both Formulas (I) and (II) may also be replaced by one of the selected groups consisting of:

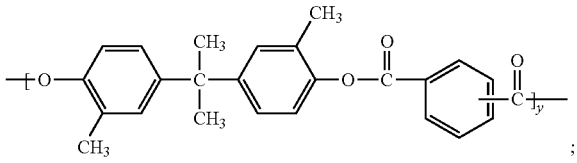

-continued

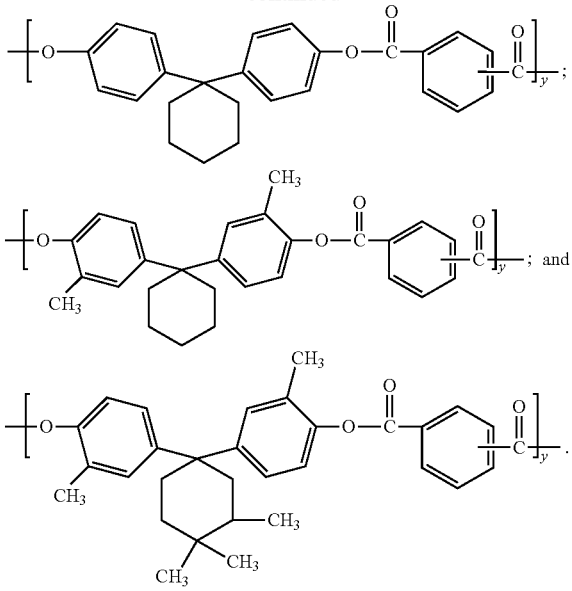

Additionally, the phthalic acid terminal block (B) in the A-B diblock copolymer may be replaced with a terephthalic acid, an isophthalic acid represented by the following, respectively:

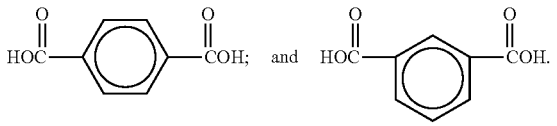

Or alternatively by an adipic acid or an azelaic acid shown below:

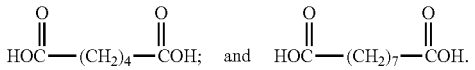

In yet another extended modified embodiment, both the segmental blocks (A) and (B) in the A-B diblock copolymer of Formulas (I) and (II), used as charge transport layer hinder, are replaced by the segmental alternates selected from groups consisting of all the variances described above to give an extended set of A-B diblock copolymers having many modified molecular structures.

Likewise, the film forming low surface energy polycarbonate for the formulation of the polymer blended overcoat of this disclosure in the embodiments is also derived from the modification of a bisphenol A polycarbonate of poly(4,4'-isopropylidene diphenyl carbonate) by the inclusion of small fraction of between about 2 and about 10 weight percent of polydimethyl siloxane (PDMS) linkages of the molecular weight in the main polycarbonate chain back bone shown in Formula (1).

Formula (1)

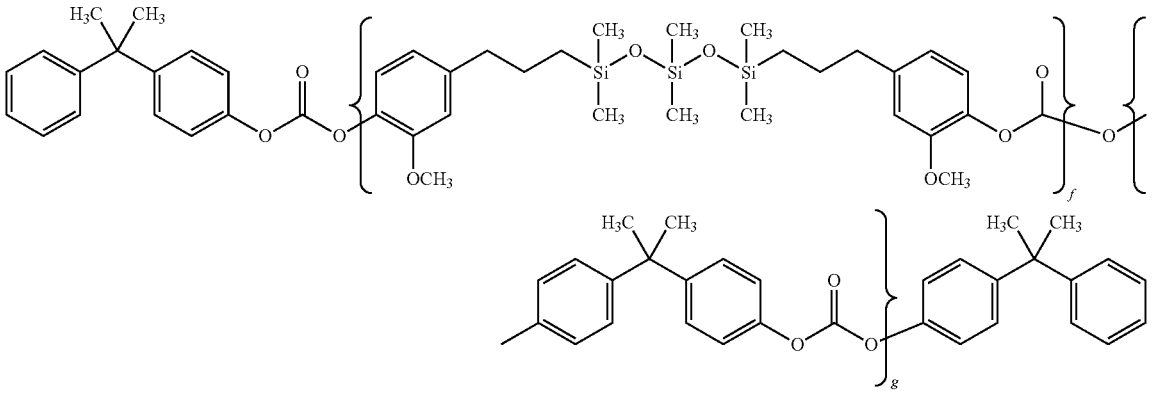

wherein x is a number between about 10 and about 50 while f and g are numbers representing the respective repeating units such that f is between about 1 and about 4 and g is from about 10 to about 100, determined based on a weight average molecular weight of from about 15,000 to about 130,000 of the low surface energy polycarbonate.

The example of one specific low surface energy bisphenol A polycarbonate selected to have the Formula (1) structure for present binary polymer blending overcoat formulation is commercially available as LEXAN EXL 1414T or LEXAN EXL 1463C from Sabic Innovative Plastics. The specific low surface energy bisphenol A polycarbonate obtained as LEXAN EXL 1463C is a modification of bisphenol A polycarbonate of poly(4,4'-isopropylidene diphenyl carbonate) having the inclusion of small fraction of between about 2 and about 10 weight percent of polydimethyl siloxane (PDMS) linkages in a 25,000 weight average molecular weight main polycarbonate chain back bone according to below Formula (1)

Formula (1)

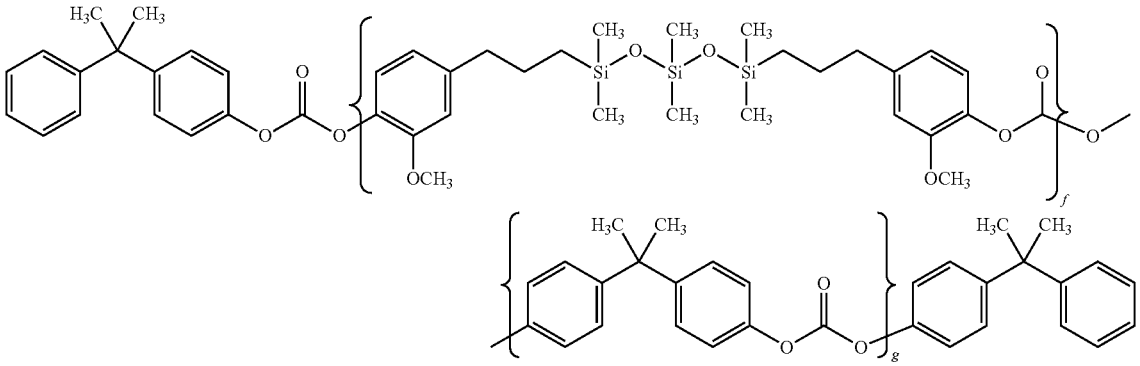

wherein x is 10, and f and g are numbers representing each respective repeating segments, for example, wherein f is 1, y is 2, and g is 80 determined based on the 25,000 weight average molecular weight of the low surface energy polycarbonate.

However, to broad disclosure coverage, the low surface energy polycarbonate candidate used for polymer blending overcoat formulation does also include a modified Bisphenol Z polycarbonate of poly(4,4'-diphenyl-1,1'-cyclohexane carbonate) having a small fraction of polydimethyl siloxane in the polymer back bone and having the following Formula (2):

Formula (2)

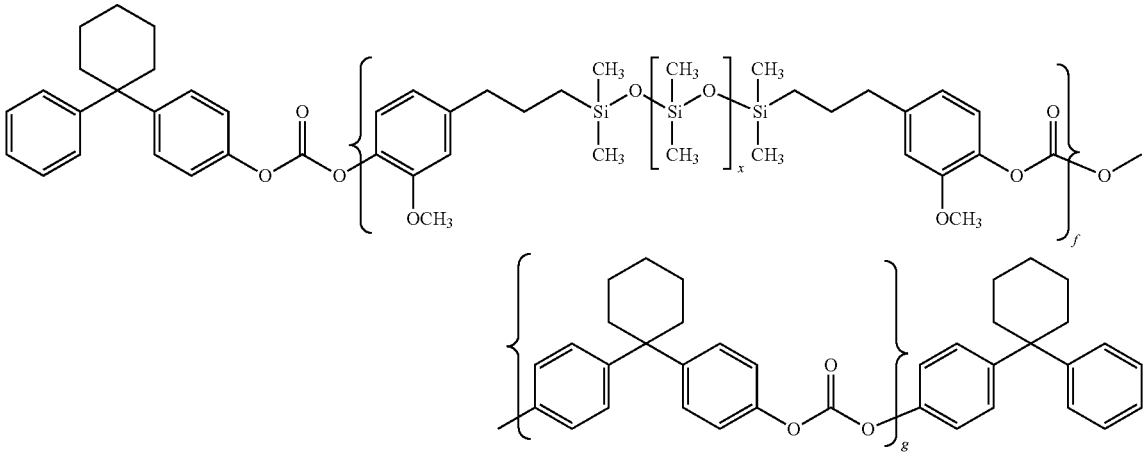

wherein x is a number between about 10 and about 50 while f and g are numbers representing the respective repeating units such that f is between about 1 and about 4 and g is from about 10 to about 100 determined based on a weight average molecular weight of from about 15,000 to about 130,000 of the low surface energy polycarbonate. Furthermore, a modified bisphenol C polycarbonate may be derived from the modification of poly(4,4'-isopropylidene diphenyl carbonate) having a small fraction of polydimethyl siloxane in the polymer back bone and having the following Formula (3):

Formula (3)

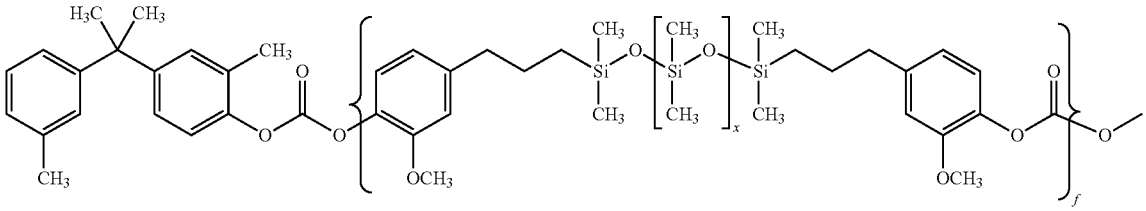

-continued

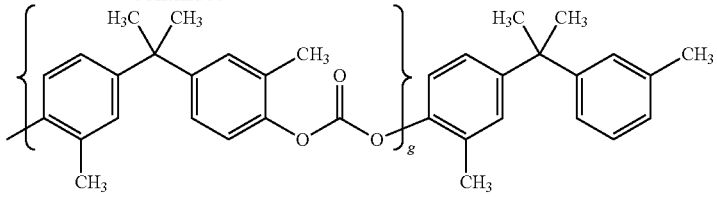

wherein x is a number between about 10 and about 50 while f and g are numbers representing the respective repeating units such that f is between about 1 and about 4 and g is from about 10 to about 100 determined based on a weight average molecular weight of from about 15,000 to about 130,000 of the low surface energy polycarbonate. Yet another modification may be derived from the modified bisphenol Z polycarbonate of poly(4,4'-diphenyl-1,1'-cyclohexane carbonate) having a small fraction of polydimethyl siloxane in the polymer back bone and having the following Formula (4):

Formula (4)

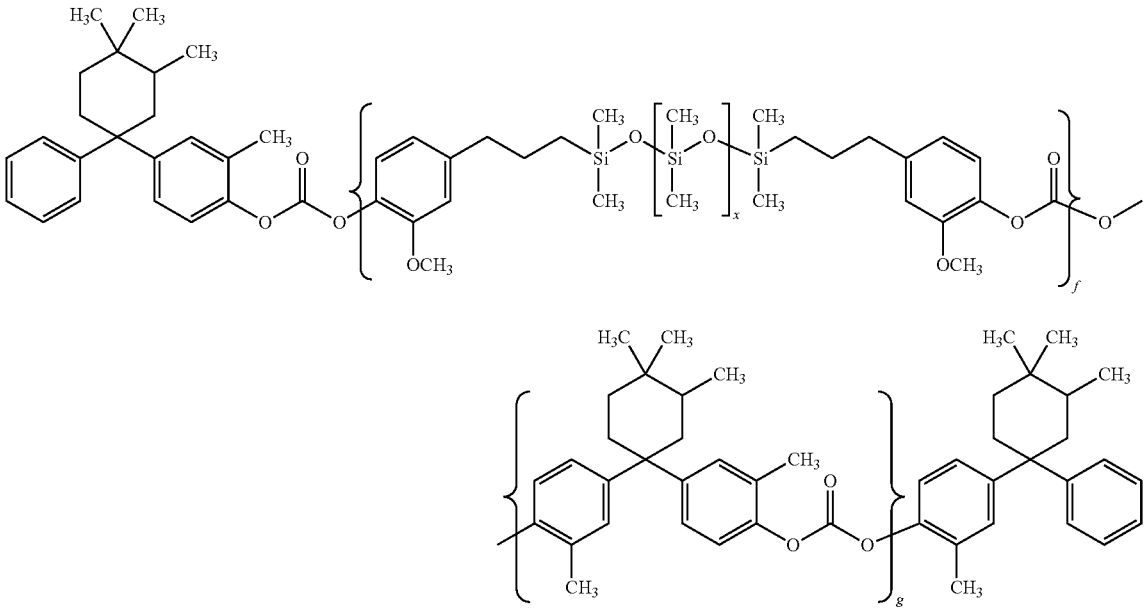

wherein x is a number between about 10 and about 50 while f and g are numbers representing the respective repeating units such that f is between about 1 and about 4 and g is from about 10 to about 100 determined based on a weight average molecular weight of from about 15,000 to about 130,000 of the low surface energy polycarbonate and mixtures thereof. Each of the resulting imaging members prepared in these embodiments has an anticurl back coating positioned on backside of the substrate opposite to the CGL 38 and the CTL 40 to maintain imaging member flatness.

In these embodiments, the CTL 40 of the imaging members is covered and protected with the outermost overcoat layer 42 which is formulated and prepared to have a thickness of from about 1 to about 10 micrometers or from about 2 to about 6 micrometers. The prepared overcoat comprises a weight ratio of diblock copolymer to low surface energy polycarbonate of between about 5:95 and about 95:5 and may also include a diamine charge transport compound N,N'-diphenyl-N,N'-bis (3-methylphenyl)-1,1'-biphenyl-4,4'-diamine of from about 0 to about 10 weight percents, or from about 1 to about 5 weight percents, based on the total weight of the prepared overcoat 42.

In the further additional embodiment extensions, the design of overcoat 42 of present disclosure in the flexible multilayered electrophotographic imaging member may alternatively be formulated and prepared to comprise the A-B diblock copolymer of Formulas (I) and (II) plus the incorporation of a lubricating liquid selected from, for example, a slip agent. The slip agent, commercially available from BYK Chemie, has the molecular formula shown below:

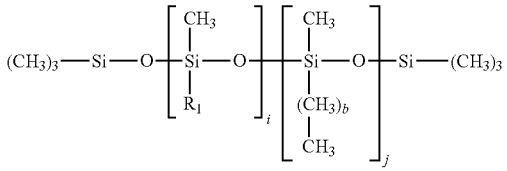

wherein i and j are between about 5 and about 50, b is a number between 0 and 10, and $R_1$ is as defined below.

$R_1$ is $-CH_2-(O-\overset{O}{\overset{\|}{C}}-R_2-\overset{O}{\overset{\|}{C}}-O-R_3)_k-OR_4$ wherein k is an integer between about 1 and about 30, $R_2$ and $R_3$ are alkylene groups containing from 1 to 10 carbon atoms, and $R_4$ is a hydrogen atom or an alkyl group containing 1 to 3 carbon atoms.

En the final embodiments, the overcoat 42 of present disclosure is formulated to comprise hybrid inorganic/organic Polyhedral Oligomeric Silsesquioxane (POSS) nano-particle dispersion in the A-B diblock copolymer to impact maximum mechanical performance and surface slipperiness. POSS is nanoscopic size particles of chemical structured, hybrid intermediate between that of a silica and silicones. As it is nanostructured in size, ranging from about 1 to about 3 nanometers, the dispersion of POSS in a polymer binder matrix to form a nano composite layer has been used to yield reinforcement to impact physical and mechanical robust function.

Since the anatomy of a POSS nanostructured chemical is based according to that, shown below, it does therefore have a wide variety of molecular structures:

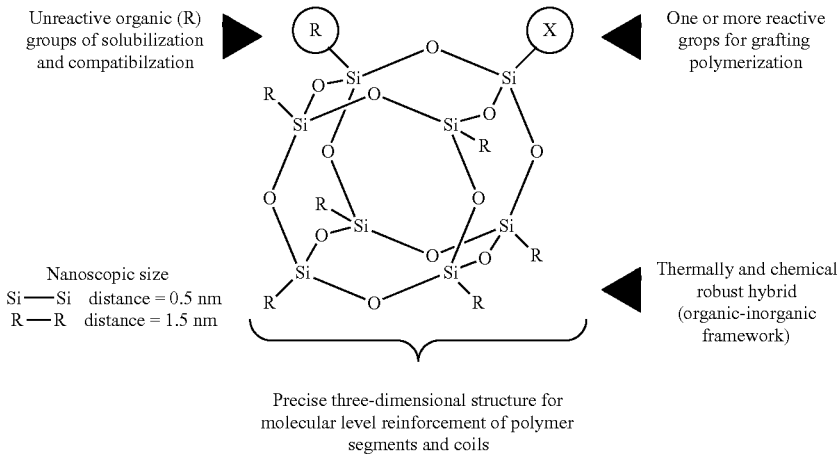

However, for reasons of simplicity, a selected few exemplary of POSS species are shown, in the following, as representative examples:

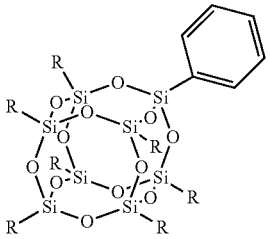

R = i-octyl

-continued

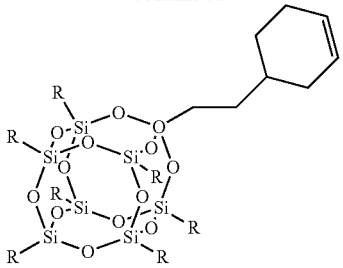

R = cyclopentyl

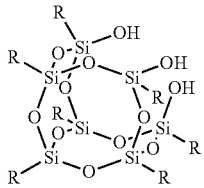

R = t-butyl, cyclopentyl, cyclohexyl, phenyl

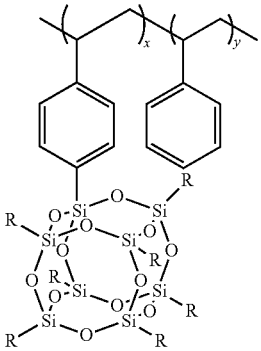

R = phenyl

-continued

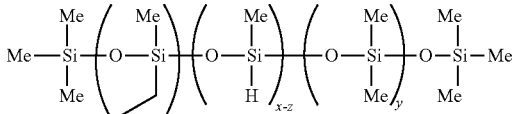

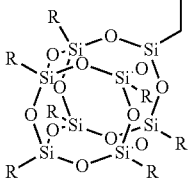

R = t-butyl, cyclopentyl, cyclohexyl, phenyl

-continued

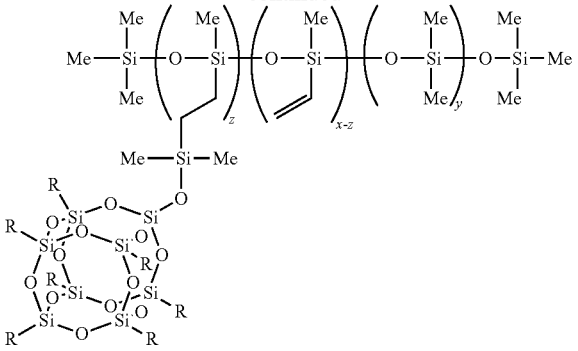

R = t-butyl, cyclopentyl, cyclohexyl, phenyl

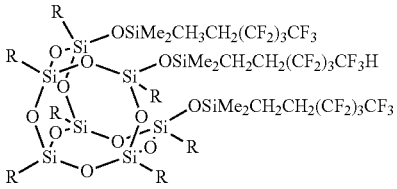

R = t-butyl, cyclopentyl

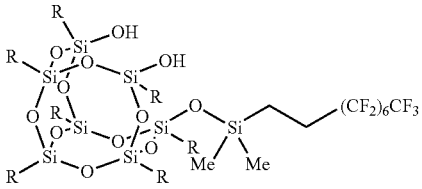

R = cyclopentyl

The present disclosure shows that incorporation of from about 1 to about 10 weight percent of a particularly selected POSS dispersion, for example, those containing a low surface energy pendant side group of polysiloxane (PDMS) and polytetrafluoroethylene (PTFE) into a overcoat, based on the resulting weight of the overcoat, to render surface slippery characteristic not only effectively enhances the respective overcoat layer's hardness to improve abrasion/wear resistance, but also produces surface lubricity/contact friction reduction to ease cleaning blade sliding action as well as surface adhesiveness to eliminate the propensity of imaging member surface filming formation. The PDMS containing POSS materials of interest for the present disclosure application include, for example, poly(dimethyl-co-methyl-co-methylethylsiloxy POSS) siloxane; poly(dimethyl-co-methylvinyl-co-methylethylsiloxy POSS) siloxane, poly(dimethyl-co-methylhydrido-co-methylpropyl POSS) siloxane, poly (dimethyl-co-hydrido-co-methylpropyl POSS) siloxane, poly(dimethyl-co-methylvinyl-co-methylethylsiloxy POSS) siloxane, and the like.

Other slippery, PTFE containing, POSS particles used in the embodiments for overcoat layer dispersion include fluoro (13)disilanolisobutyl POSS, trisfluoro(13)cylcopentyl POSS, fluoro(13)disilanolcyclopentyl POSS, methacrylfluoror(3) POSS, and the like.

In these embodiments, the POSS containing the outermost overcoat layer 42 has a thickness of from about 1 to about 10 micrometers or from about 2 to about 6 micrometers. The prepared overcoat may also include a diamine charge transport compound N,N'-diphenyl-N,N'-bis(3-methylphenyl)-1,1'-biphenyl-4,4'-diamine of from about 0 to about 10 weight percent, or from about 1 to about 5 weight percents, based on the total weight of the prepared overcoat 42.

Figure 3:
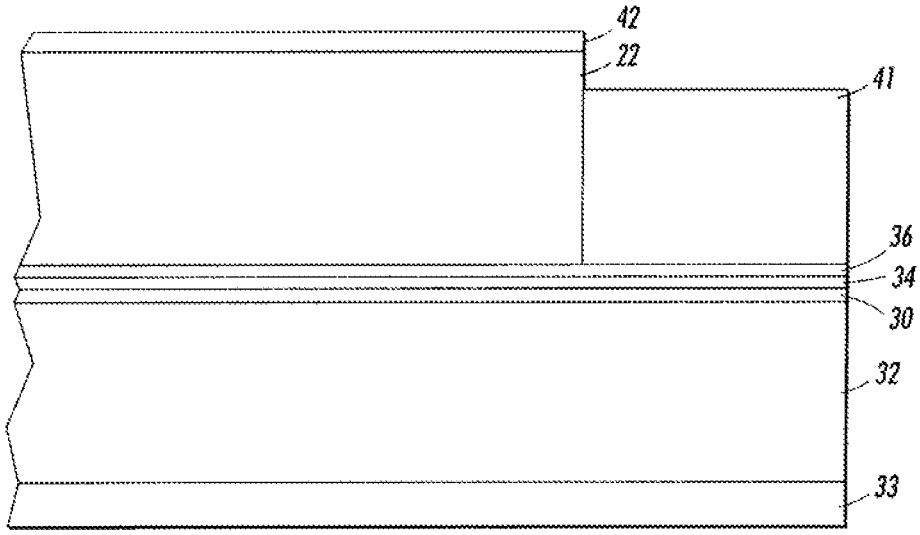
FIG. 3 is a cross-sectional view of another flexible multilayered electrophotographic imaging member which has a simplified single imaging layer with both charge transporting and charge generating capabilities and also contains an overcoat layer prepared according to the present embodiments.

As an alternative to the two discretely separated CTL 40 and CGL 38, structurally simplified flexible imaging member, as shown in FIG. 3, can be created to comprise only a single imaging layer 22 (having both charge generating and charge transporting capabilities), with the other layers of the imaging member being formed in the exact same manners as described above, for the inclusion of the overcoat layer 42 of this disclosure. The imaging layer 22 is formed to comprise only one single electrophotographically active layer capable of retaining an electrostatic charge in the dark during electrostatic charging, imagewise exposure and image development, as disclosed, for example, in U.S. Pat. No. 6,756,169. The single imaging layer 22 may include charge transport molecules in a binder, similar to those of the CTL 40 and optionally may also include a photogenerating/photoconductive material, similar to those of the CGL 38 described above. In this embodiment, the flexible imaging member of this disclosure, shown in FIG. 3, is provided with an overcoat 42, prepared to comprise the very exact same formulations, compositions, and variances as those disclosed in all the preceding, to effect physical/function and provide chemical contaminant protection over the imaging layer 22 for service life extensions.

In all the flexible multilayered electrophotographic imaging members embodiments disclosed above, the overcoat layer 42, may also contain inorganic, organic, or inorganic/organic hybrid fillers (from about 2 to about 10 weight percent based on the total weight of the resulting overcoat) to impart further wear resistant enhancement. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nanosized inorganic or organic particles can be used as fillers to achieve mechanical property reinforcement. The overcoat layer formulations as disclosed in all the above embodiments are equally applicable as a protective overcoat for all multilayered electrophotographic imaging members in rigid drum design and acceptable for both flexible and rigid drum electrographic imaging member applications as well.

The process of this disclosure for fabricating the flexible multilayered electrophotographic imaging member webs described in all the above embodiments comprise providing a substrate layer having a first side and a second side, and at least a first parallel side and a second parallel side. The substrate may further include a conducting layer. The process includes forming at least one imaging layer on the first side of the substrate, forming an overcoat layer of the present disclosure over the at least one imaging layer, and then forming an anticurl back coating on the second side of the substrate to render the imaging member desired flatness. Additionally, there may also be included steps and process for forming the disclosure overcoat layer on the at least one imaging layer, as well as for forming an optional ground strip layer on the at least one imaging layer.

The multilayered, flexible multilayered electrophotographic imaging member web stocks fabricated in accordance with the embodiments described herein may be cut into rectangular sheets. Each cut sheet is then brought overlapped at ends thereof and joined by any suitable means, such as ultrasonic welding, gluing, taping, stapling, or pressure and heat fusing to form a continuous imaging member seamed belt, sleeve, or cylinder.

The overcoated flexible imaging member belt prepared may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

The flexible electrophotographic imaging member can be evaluated by printing in a marking engine into which a photoreceptor belt formed according to any of these exemplary embodiments has been installed. For the intrinsic electrical properties, it can also be investigated by mounting imaging member sample(s) on a conventional electrical drum scanner. Alternatively, the impact on charge deficient spots development propensity or suppression can also be evaluated using electrical techniques, such as those disclosed in U.S. Pat. Nos. 5,703,487; 5,697,024; 6,008,653; 6,119,536; 6,150,824 and 5,703,487, which are incorporated herein in their entireties by reference.

All the patents and applications referred to herein are hereby specifically, and totally incorporated herein by reference in their entirety in the instant specification.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The development of the presently disclosed embodiments will further be demonstrated in the non-limiting working examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the present embodiments can be practiced with many types of compositions and can have many different uses in accordance with the disclosure above and as pointed out hereinafter.

Control Example

A conventional flexible electrophotographic imaging member web, as shown in FIG. 1, is prepared by a hand-coating process and was provided on a 0.02 micrometer thick titanium layer 30 coated substrate of a biaxially oriented polyethylene naphthalate substrate 32 (PEN (available as KADALEX from DuPont Teijin Films)) having a thickness of 3.5 mils. The titanized KADALEX substrate was extrusion-coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer 34 had an average dry thickness of 0.04 micrometer as measured with an ellipsometer.

An adhesive interface layer 36 was then applied by extrusion coating to the blocking layer with a coating solution containing 0.16 percent by weight of ARDEL polyarylate, having a weight average molecular weight of about 54,000 (available from Toyota Hsushu, Inc.), based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer 36 had a dry thickness of about 0.02 micrometer.

The adhesive interface layer was thereafter coated over with a charge generating layer 38. The charge generating layer dispersion was prepared by adding 0.45 gram of IUPILON 200, a polycarbonate of poly(4,4'-diphenyl)-1,1'-cyclohexane carbonate (PCZ 200 (available from Mitsubishi Gas Chemical Corporation)), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-Z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer (CGL) to facilitate adequate electrical contact by a ground strip layer 41 to be applied later. This CGL comprised of poly(4,4'-diphenyl)-1,1'-cyclohexane carbonate, tetrahydrofuran and hydroxygallium phthalocyanine was dried at 125° C. for 2 minutes in a forced air oven to form a dry CGL 18 having a thickness of 0.7 micrometers.

This coated web was simultaneously coated over with a charge transport layer (CTL) 40 and a ground strip layer 41 by co-extrusion of the coating materials. The CTL 40 was prepared by introducing into an amber glass bottle in a weight ratio of 1:1 (or 50 weight percent of each) of a bisphenol A polycarbonate thermoplastic (FPC 0170, having a molecular weight of about 120,000 and commercially available from Mitsubishi Chemicals Corp.) and a diamine charge transport compound of N,N'-diphenyl-N,N'-bis(3-methylphenyl)-1,1'-biphenyl-4,4'-diamine.

The resulting mixture was dissolved to give 15 percent by weight solid in methylene chloride. This solution was applied on the CGL 38 by extrusion process to form a coating which after drying in a forced air oven gave a 29 micrometers thick dry CTL 40 comprising 50:50 weight ratio of diamine transport charge transport compound to FPC0170 bisphenol A polycarbonate binder. The imaging member web, at this point if unrestrained, would curl upwardly into a 1¾-inch tube.

The strip, about 10 millimeters wide, of the adhesive layer left uncoated by the CGL, was coated with a ground strip layer during the co-extrusion process. The ground strip layer coating mixture was prepared by combining 23.81 grams of polycarbonate resin (FPC 0170 (available from Mitsubishi Chemical Corp.)) having 7.87 percent by total weight solids and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (ACHESON Graphite dispersion RW22790 (available from Acheson Colloids Company (Port Huron, Mich.))) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer.

The imaging member web stock containing all of the above layers was then placed in a 125° C. forced air oven to dry the co-extrusion coated ground strip 41 and CTL 40 simultaneously to give respective 19 micrometers and 29 micrometers in dried thicknesses after eventual cooling down to room ambient. The resulting imaging member web had a 29 micrometer-thick single layered CTL 40, according to the conventional art shown in FIG. 1, but without application of an anticurl back coating was seen, if unrestrained as it cooled down to room ambient of 25° C., to spontaneously curl upwardly into a 1½ inch roll.

An anticurl back coating was prepared by combining 882 grams of FPC 0170 bisphenol A polycarbonate resin of Formula (A), 71.2 grams VITEL PE-200 copolyester (available from Goodyear Tire and Rubber Company) and 10,710 grams of methylene chloride in a carboy container to form a coating solution containing 8.9 percent solids: The container was covered tightly and placed on a roll mill for about 24 hours until the polycarbonate and polyester were dissolved in the methylene chloride to form the anti-curl back coating solution. The anticurl back coating solution was then applied to the rear surface (side opposite the CGL and charge CTL) of the electrophotographic imaging member web by extrusion coating and dried to a maximum temperature of 125° C. through the forced air oven to produce a dried 17 micrometer thick anticurl back coating 33 and render the imaging member web with desirable flatness. The flexible imaging member thus obtained was used to serve as a control.

Disclosure Example I

Three flexible electrophotographic imaging member webs of the present disclosure was then prepared, using the very exact same materials and following the same procedures as those described in the Control Imaging Member Example above, except that the top exposed CTL 40 of each imaging member web was solution coated over to give a protective overcoat layer 42 of this disclosure as illustrated in FIG. 2. The overcoat was formulated to comprise a binary polymer blending of an A-B diblock copolymer and a low surface energy polycarbonate. The specific A-B diblock copolymer chosen to meet the present flexible imaging member overcoat layer binary polymer blending requirement was LEXAN HLX copolymer (available from Sabic Innovative Plastics); it had a weight average molecular weight about 115,000 and molecular formulas of:

Formula (I)

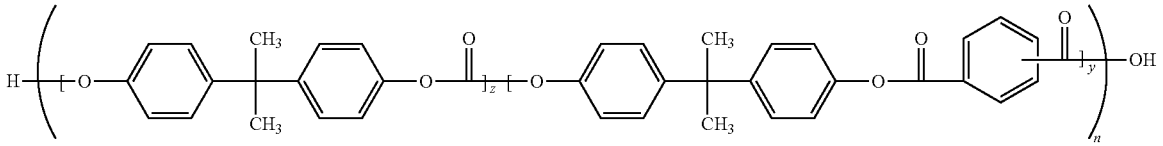

Block (A) Block (B)

Formula (II)

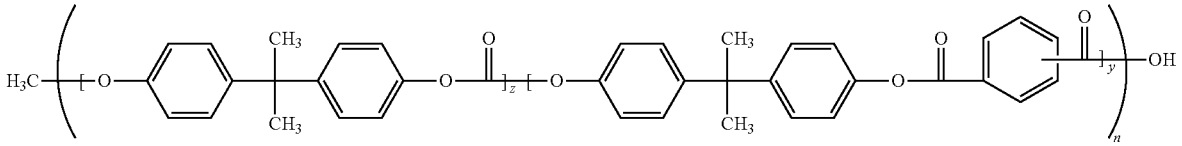

Block (A) Block (B)

In these formulas, z represents the number of bisphenol A repeating units in block A of about 9 (or 90 mole percent); y is the number of repeating phthalic acid block B of about 1 (or 10 mole percent) and n is the degree of polymerization. The degree of polymerization, n, is about 20 for the diblock copolymer having a molecular weight of about 115,000.

The low surface energy polycarbonate used for polymer blending, having a weight average molecular weight of about 25,000 selected for polymer blending to form the overcoat, is a PDMS containing a bisphenol A polycarbonate of poly(4, 4'-isopropylidene diphenyl carbonate). It was also available from Sabic Innovative Plastics as LEXAN EXL1463C and had the following Formula (1):

Formula (1)

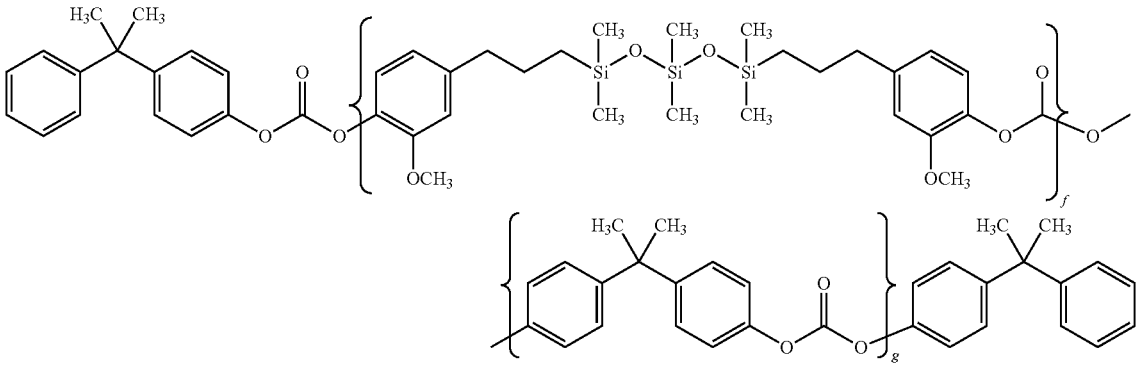

wherein x is 10 while f and g are numbers representing each respective repeating segments such that f is 1 and g is 80 for the 25,000 weight average molecular weight low surface energy LEXAN EXL 1463C polycarbonate used in overcoat polymer blending preparation.

The three polymer blended overcoats as prepared had weight ratios of LEXAN HLX to LEXAN EXL1463C of 75:25, 50:50, and 25:75; they were dissolved in methylene chloride and applied by solution coating directly over the CTL of each respective imaging member web. After drying at 120° C., the applied wet coating gave a 3-micrometer dried overcoat layer thickness of this disclosure.

Physical/Mechanical and Photo-Electrical Evaluations

The three flexible imaging members webs prepared to have the protective overcoat according to the Disclosure Example I were assessed for each respective mechanical/photoelectrical properties along with the Control Imaging Member having no overcoat layer of Control Example.

The surface contact friction measurement was conducted by sliding an elastomeric polyurethane blade over the surface of each desired outer exposed layer of the imaging member; the coefficient of each surface contact friction was then calculated by dividing the force required to slide the blade over the surface layer by the normal force acted on the surface by the blade. For surface adhesiveness determination, a one inch width Scotch Masking Tape (available from 3M Company) was first laid over the exposed outer layer of each imaging member by rolling a 5 lbs weight over the tape; and then a 180° tape peel-off test was carried out to give a peel strength of force per inch width that was required to peel the tape off from the CTL for each imagine member. In addition, the surface energy of each exposed outer layer was determined by liquid wetting contact angle measurement method.

For wear resistance assessment, the solutions of the three overcoat formulations were again prepared and coated over a 3½ mil thick PEN substrate, by hand coating procedures, to give a coating layer of 29 micrometers in dried thickness. The three overcoat layers as obtained and the control imaging member were then determined and evaluated for wear resistance by sliding action of each against a glass surface under a specific control testing condition in the lab. Thickness wear-off of each respective sample was measured, using a permanscope, after 330,000 dynamic sliding wear actions.

The results obtained (tabulated in Table 1 below) show imaging member webs containing the added-on overcoat gave significant surface energy lowering effect, coefficient of sliding friction reduction, and surface adhesiveness as reflected by the extremely low 3M tape peel-off strength from each overcoat surface as compared to the control imaging member counterpart having no inclusion of an overcoat. It should also be noted that when lab samples wear tested against the sliding action of glass surface, all the overcoat layer were found to effect surface wear-off suppression by more than 35 percent compared to the control imaging member having the un-protected charge transport layer.

TABLE 1

| Overcoat Layer Identification (HLX:EXL Ratio) | Surface Energy (dynes/cm) | Coefficient of Static Friction (against blade) | 180° Tape Peel Strength (gms/cm) | Thickness Worn (microns) |
|---|---|---|---|---|
| Control (No Overcoat) | 32 | 1.18 | 241 | 15.1 |
| 75:25 | 26 | 0.78 | 56 | 9.8 |
| 50:50 | 24 | 0.67 | 45 | 9.3 |
| 25:75 | 22 | 0.62 | 40 | 8.7 |

All the above overcoated imaging members of Disclosure Example I had further been determined for each respective photo-electrical properties against the non overcoated imaging member control using the 4,000 lab scanner. The field study results thus obtained are presented in the Table 2 below.

TABLE 2

| Imaging Member OVERCOAT LAYER | | 0K cycles | | | After 10K cycles | | |
|---|---|---|---|---|---|---|---|
| ID HLX:EXL Ratio | $V_{ddp}$ | 3.5 ergs $V_{bg}$ | Dark Decay A | 300 erg $V_r$ | 3.5 ergs $V_{bg}$ | Dark Decay A | 300 erg $V_r$ |
| CTROL (No Overcoat) | 500 | 48 | −114 | 16 | 87 | −98 | 33 |
| 75:25 | 500 | 49 | −106 | 17 | 86 | −96 | 31 |
| 50:50 | 500 | 48 | −110 | 15 | 85 | −93 | 30 |
| 25:75 | 500 | 47 | −109 | 16 | 86 | −95 | 29 |

The data shown in the above Table 2 do therefore confirm and assure that inclusion of an added-on overcoat of this disclosure to the imaging members, as described in the preceding Examples, to achieve physical/mechanical/chemical enhancements, did not alter the crucially important photoelectrical integrity of the imaging member control.

Disclosure Example II

Another flexible electrophotographic imaging member webs of the present disclosure was then prepared, using the very exact same materials and following the same procedures as those described in the Control Imaging Member Example above, except that the top exposed CTL 40 of the imaging member web coated over with another overcoat formulation prepared to comprise of LEXAN HLX A-B diblock copolymer and a liquid slip agent (a siloxane containing macromer available BYK Chemie, USA) dissolve in methylene chloride to form coating solution. The slip agent selected for use has a molecular formulas shown below:

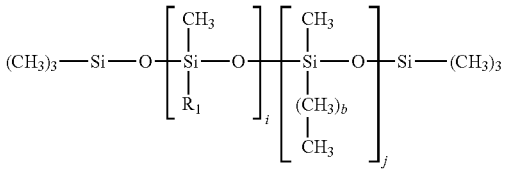

wherein i and j are between about 5 and about 50, b is a number between 0 and 10, and $R_1$ is as defined below:

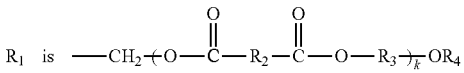

wherein k is an integer between about 1 and about 30, $R_2$ & $R_3$ are alkylene groups containing from 1 to 10 carbon atoms, and $R_4$ is a hydrogen atom or an alkyl group containing 1 to 3 carbon atoms.

After drying at 120° C., the applied wet coating likewise gave a 3-micrometer dried overcoat layer thickness. The resulting overcoat layer had slippery surface and contained 0.25 weight percent slip agent based on the total weight of the prepared overcoat layer.

The prepared overcoated imaging member was first analyzed for surface adhesiveness by 180° 3M tape peel testing method. The tape peeling off test results showed that the BYK slip agent inclusion in the overcoat was effective to render surface adhesiveness since it would take about 98 gms/cm force to peel the tape off from the overcoat as compared to the 245 gms/cm obtained for the CTL of control imaging member counterpart having no overcoat layer.

Photoelectrical Measurements

Figure 4:
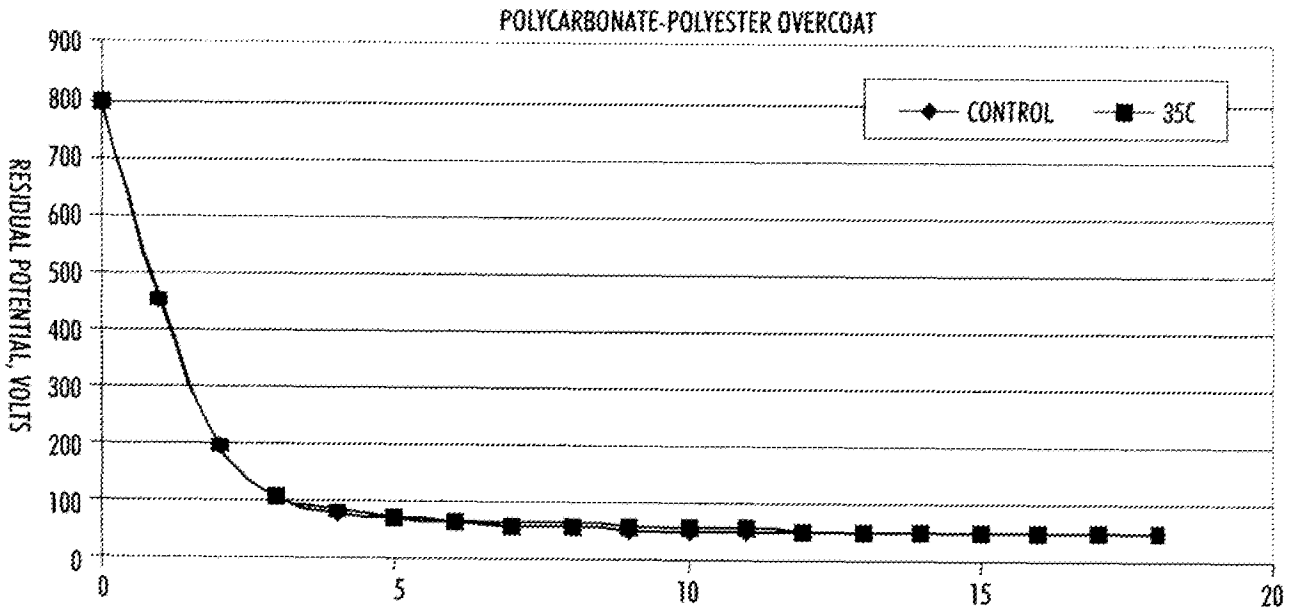
FIG. 4 illustrates photoelectrical integrity of photo-induced discharge characteristic of the flexible multilayered electrophotographic imaging member prepared to include an overcoat layer according to the present embodiments.

The photoelectrical properties of the above over-coated imaging member web of Disclosure Example II and the control imaging member were then determined by using the 4000 lab scanner. The measurement results thus obtained, shown in Table 3 and the photo-induced discharge characteristic (PIDC) in FIG. 4, indicate that imaging member prepared, to include an overcoat layer (identified as 35C in FIG. 4), consisting of a phthalic acid terminated A-B diblock copolymer for effecting amine compound elimination/neutralization and a BYK slip agent for surface energy reduction, did not cause any adverse impact to photoelectrical integrity of the original AMAT P/R control.

TABLE 3

| Imaging Member ID | $V_0$ | S | $V_c$ | $V_r$ | $V_{dd}$ |
|---|---|---|---|---|---|
| Control (No Overcoat) | 800 | 360 | 163 | 46 | 29 |
| HLX/BYK Overcoat | 800 | 381 | 174 | 48 | 28 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. A flexible imaging member comprising:

a flexible substrate;

a charge generating layer disposed on the substrate;

at least one charge transport layer disposed on the charge generating layer; and an overcoat layer disposed over the at least one charge transport layer, wherein the overcoat layer comprises a blend of a polycarbonate and a low surface energy polycarbonate, and further wherein the polycarbonate is an A-B diblock copolymer comprising a bisphenol A polycarbonate segment block (A) and a phthalic acid containing segment block (B) terminal capable of providing protection against amine species contaminants, selected from the group consisting of Formula (I) and Formula (II) below:

Formula (I)

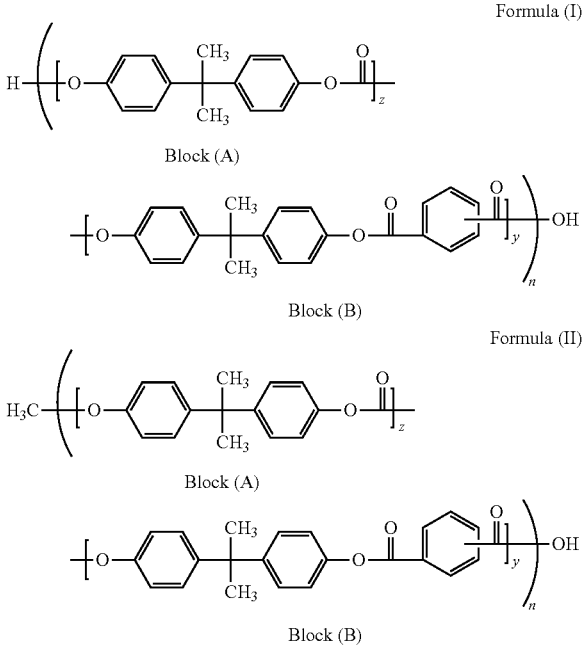

wherein z represents the number of bisphenol A repeating units in block A of from about 9 to about 18, y is number of repeating phthalic acid block B of from about 1 to about 2, and n is the degree of polymerization between about 20 and about 80 for the copolymer having a weight average molecular weight between about 100,000 and about 200,000, and mixtures thereof, while the low surface energy polycarbonate is selected from the group consisting of a bisphenol A polycarbonate of poly(4,4'-isopropylidene diphenyl carbonate) modified by including a small fraction of polydimethyl siloxane (PDMS) linkages in the main polycarbonate chain back bone to obtain Formula (1) below:

Formula (1)

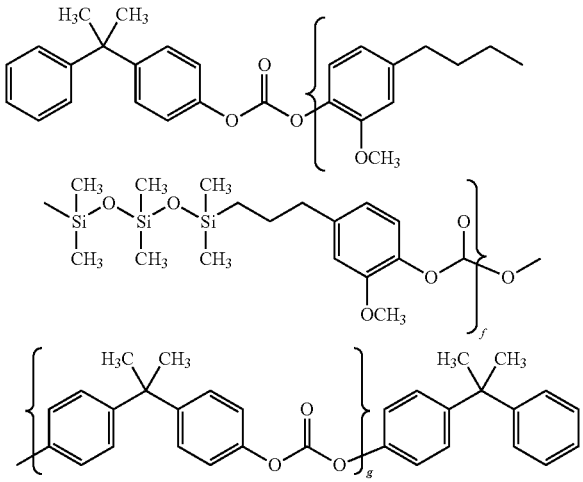

wherein x is a number from about 10 to about 50, and f and g are numbers representing each respective repeating segment such that f is from about 1 to about 4 and g is from about 10 to about 100 for a weight average molecular weight of from about 15,000 to about 130,000 of the low surface energy polycarbonate, a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (2) below:

Formula (2)

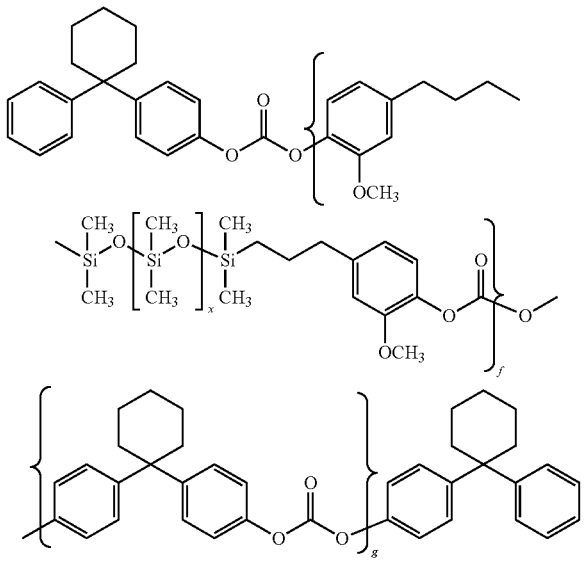

wherein x is a number from about 10 and about 50 while f and g are numbers representing each respective repeating units such that f is between about 1 and about 4 and g is from about 10 to about 100 for a weight average molecular weight of from about 15,000 to about 130,000 of the low surface energy polycarbonate, a bisphenol C polycarbonate of poly(4,4'-isopropylidene diphenyl carbonate) modified by including a small fraction of polydimethyl siloxane (PDMS) linkages into the main polycarbonate chain back bone to obtain Formula (3) below:

Formula (3)

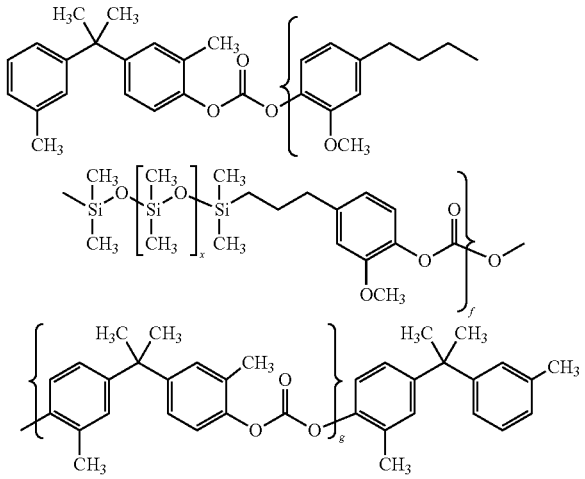

wherein x is a number from about 10 and about 50 while f and g are numbers representing the respective repeating units such that f is between about 1 and about 4 and g is from about 10 to about 100 for a weight average molecular weight of from about 15,000 to about 130,000 of the low surface energy polycarbonate, and a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (4) below:

Formula (4)

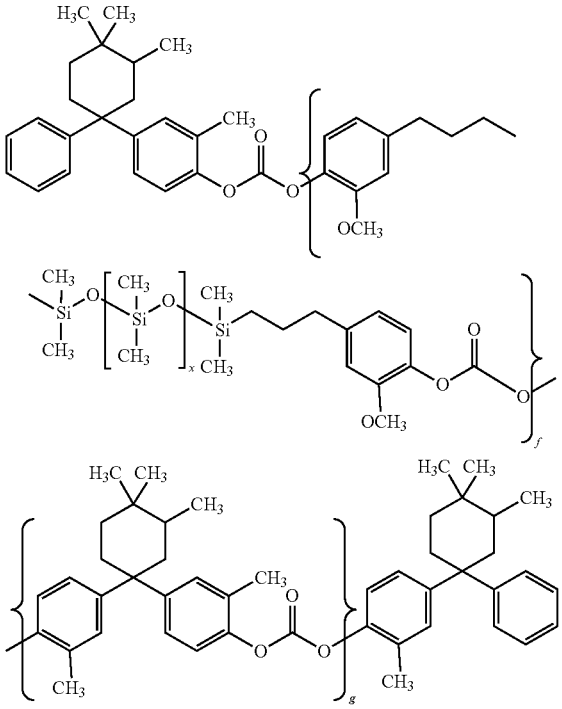

wherein x is a number from about 10 and about 50 while f and g are numbers representing the respective repeating units such that f is between about 1 and about 4 and g is from about 10 to about 100 for a weight average molecular weight of from about 15,000 to about 130,000 of the low surface energy polycarbonate, and mixtures thereof, and an anticurl back coating layer disposed on the flexible substrate on a side opposite the charge generating and charge transport layers.

2. The flexible imaging member of claim 1, wherein the degree n of polymerization of the diblock copolymer is from about 20 to about 80.

3. The flexible imaging member of claim 1, wherein a weight average molecular weight of the diblock copolymer is from about 100,000 to about 200,000 and a weight average molecular weight of the low surface energy polycarbonate is from about 15,000 to about 130,000.

4. The flexible imaging member of claim 1, wherein the overcoat layer comprises an A-B diblock copolymer of Formulas (I) and (II) and a liquid slip agent present in an amount of from about 0.05 to about 1.0 percent by weight of the overcoat layer.

5. The flexible imaging member of claim 4, wherein the liquid slip agent has the following formula:

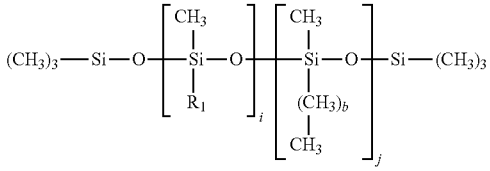

wherein i and j are from about 5 to about 50, b is a number between 0 and 10, and $R_1$ is:

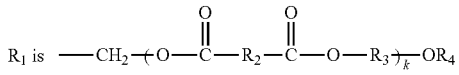

wherein k is a number from about 1 to about 30, $R_2$ and $R_3$ are alkylene groups containing from 1 to 10 carbon atoms, and $R_4$ is a hydrogen atom or an alkyl group containing from 1 to 3 carbon atoms.

6. The flexible imaging member of claim 1, wherein the overcoat layer comprises an A-B diblock copolymer of Formulas (I) and (II) and a dispersion of low surface energy nanoparticles of polyhedral oligomeric silsesquioxane (POSS).

7. The flexible imaging member of claim 6, wherein the low surface energy nanoparticles have a particle size of from about 1 to about 3 nanometers.

8. The flexible imaging member of claim 6, wherein the low surface energy nanoparticles of polyhedral oligomeric silsesquioxane are present in the overcoat layer in an amount of from about 1 to about 10 percent by weight of the overcoat layer.

9. The flexible imaging member of claim 6, wherein the low surface energy polyhedral oligomeric silsesquioxane is selected from the group consisting of poly(dimethyl-co-methyl-co-methylethylsiloxy POSS) siloxane; poly(dimethyl-co-methylvinyl-co-methylethylsiloxy POSS) siloxane, poly (dimethyl-co-methylhydrido-co-methylpropyl POSS) siloxane, poly(dimethyl-co-hydrido-co-methylpropyl POSS) siloxane, poly(dimethyl-co-methylvinyl-co-methylethylsiloxy POSS) siloxane, fluoro(13)disilanolisobutyl POSS, trisfluoro(13)cylcopentyl POSS, fluoro(13)disilanolcyclopentyl POSS, methacrylfluoror(3) POSS, and mixtures thereof.

10. The flexible imaging member of claim 1, wherein the overcoat layer has a thickness of from about 1 to about 10 micrometers.

11. The flexible imaging member of claim 10, wherein the overcoat layer has a thickness of from about 2 to about 6 micrometers.

12. The flexible imaging member of claim 1, a weight ratio of the diblock copolymer to the low surface energy polycarbonate is from about 5:95 to about 95:5.

13. The flexible imaging member of claim 1, wherein the overcoat layer further includes a diamine charge transport compound present in an amount of from about 0 to about 10 percent by weight of the overcoat layer.

14. The flexible imaging member of claim 13, wherein the diamine charge transport compound is N,N'-diphenyl-N,N'-bis(3-methylphenyl)-1,1'-biphenyl-4,4'-diamine.

15. The flexible imaging member of claim 1, wherein the overcoat layer further comprises an inorganic filler selected from the group consisting of silica, metal oxides, metal carbonate, metal silicates, and mixtures thereof.

16. The flexible imaging member of claim 1, wherein the overcoat layer further comprises an organic filler selected from stearates, fluorocarbon (PTFE) polymers, waxy polyethylene, fatty amides, stearamide, and mixtures thereof.

17. The flexible imaging member of claim 1, wherein the segmental block (A) in the diblock copolymer is replaced by a carbonate selected from the group consisting of:

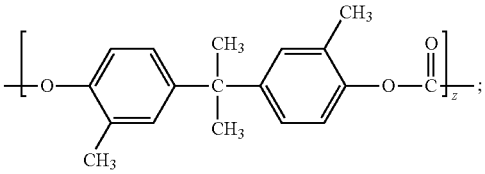

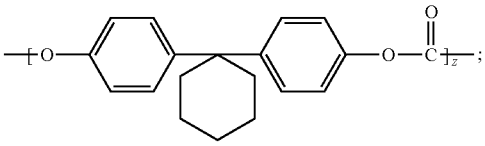

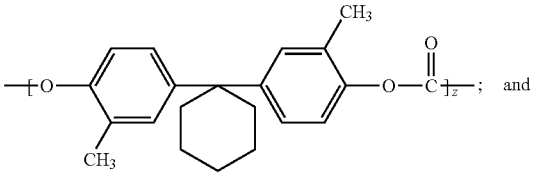

and

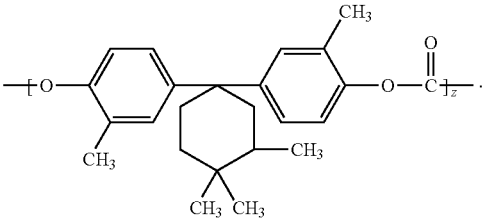

18. The flexible imaging member of claim 1, wherein the phthalic acid terminal block (B) terminal in the diblock copolymer is replaced by a compound selected from the group consisting of:

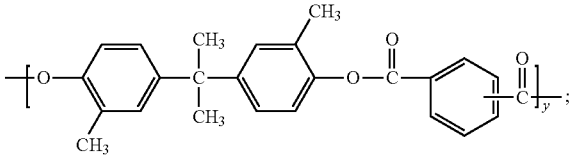

-continued

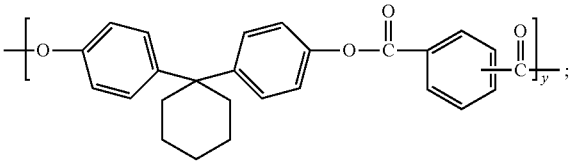

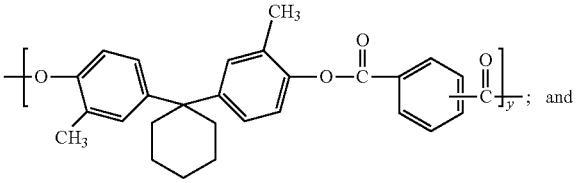

and

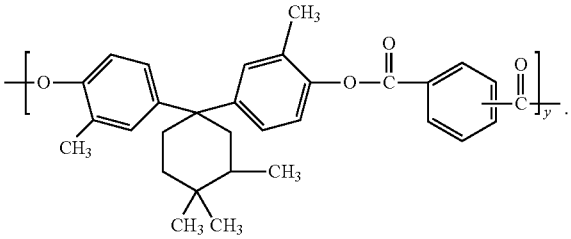

19. The flexible imaging member of claim 1, wherein the phthalic acid terminal block (B) terminal in the diblock copolymer is replaced by a terephthalic acid, an isophthalic acid, an adipic acid or an azelaic acid.

20. A flexible imaging member comprising:

a flexible substrate;

a charge generating layer disposed on the substrate;

multiple charge transport layers disposed on the charge generating layer; and an overcoat layer disposed over the multiple charge transport layers, wherein the overcoat layer comprises a blend of a polycarbonate binder and a low surface energy polycarbonate, and further wherein the polycarbonate binder is an A-B diblock copolymer comprising a bisphenol A polycarbonate segment block (A) and a phthalic acid containing segment block (B) terminal capable of providing protection against amine species contaminants, selected from the group consisting of Formula (I) and Formula (II) below:

Formula (I)

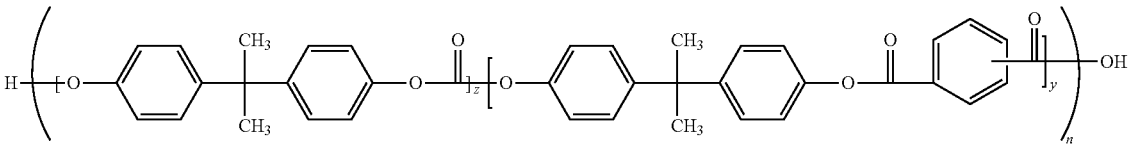

Block (A) Block (B)

-continued

Formula (II)

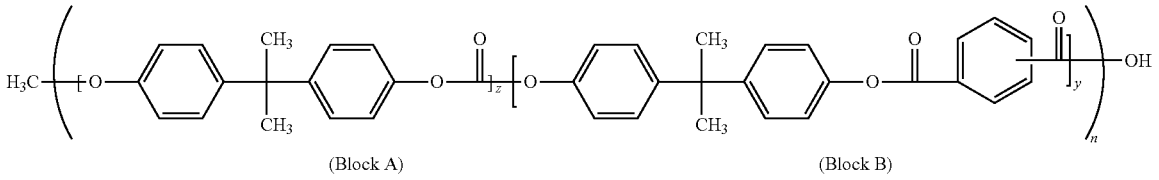

wherein z represents the number of bisphenol A repeating units in block A of from about 9 to about 18, y is number of repeating phthalic acid block B of from about 1 to about 2, and n is the degree of polymerization between about 20 and about 80 for the copolymer having a weight average molecular weight between about 100,000 and about 200,000, and mixtures thereof, while the low surface energy polycarbonate is selected from the group consisting of a bisphenol A polycarbonate of poly(4,4'-isopropylidene diphenyl carbonate) modified by including a small fraction of polydimethyl siloxane (PDMS) linkages in the main polycarbonate chain back bone to obtain Formula (1) below:

Formula (1)

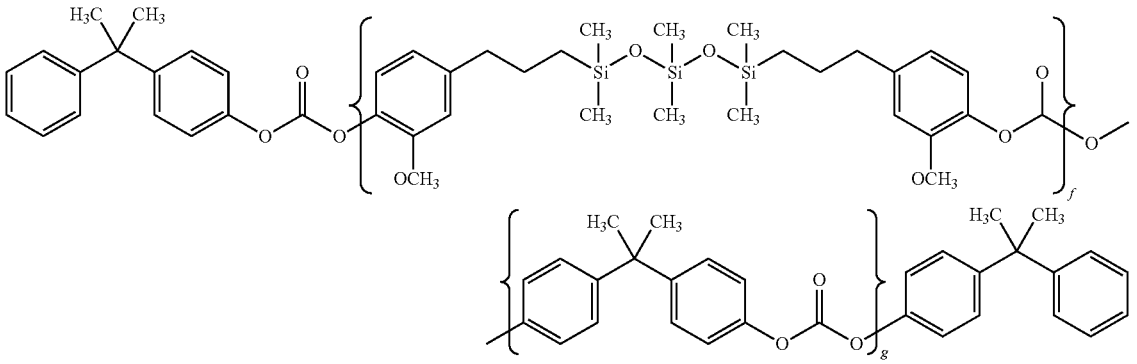

wherein x is a number from about 10 and about 50 while f and g are numbers representing the respective repeating units such that f is between about 1 and about 4 and g is from about 10 to about 100 for a weight average molecular weight of from about 15,000 to about 130,000 of the low surface energy polycarbonate, a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (2) below:

Formula (2)

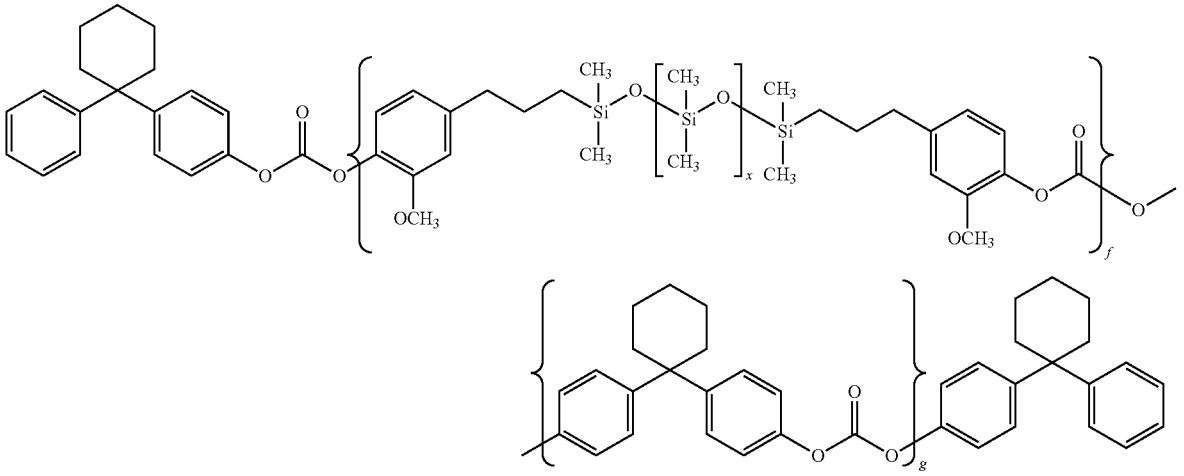

wherein x is a number from about 10 and about 50 while f and g are numbers representing the respective repeating units such that f is between about 1 and about 4 and g is from about 10 to about 100 for a weight average molecular weight of from about 15,000 to about 130,000 of the low surface energy polycarbonate, or a bisphenol C polycarbonate of poly(4,4'-isopropylidene diphenyl carbonate) modified by including a small fraction of polydimethyl siloxane (PDMS) linkages into the main polycarbonate chain back bone to obtain Formula (3) below:

Formula (3)

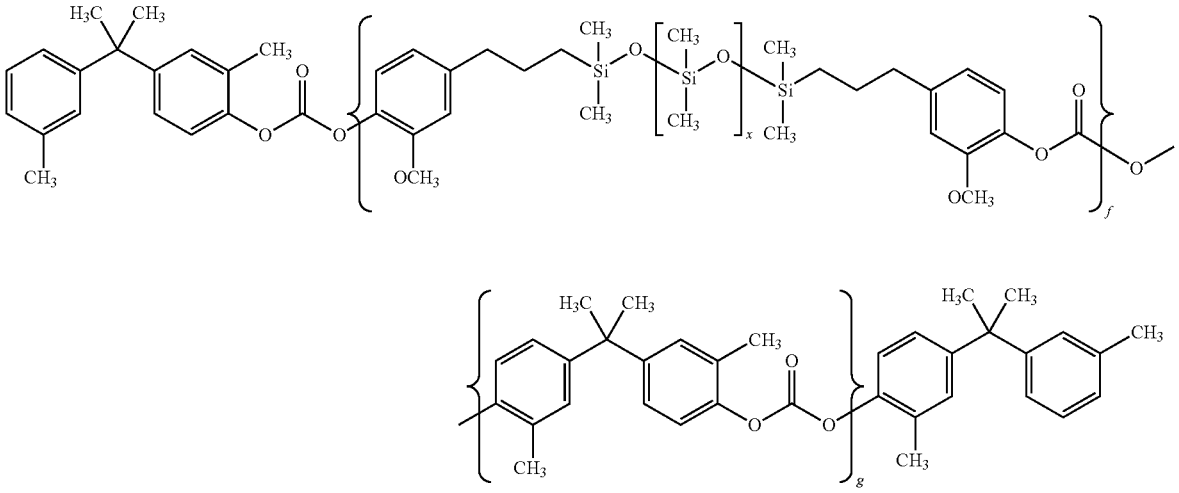

wherein x is a number from about 10 and about 50 while f and g are numbers representing the respective repeating units such that f is between about 1 and about 4 and g is from about 10 to about 100 for a weight average molecular weight of from about 15,000 to about 130,000 of the low surface energy polycarbonate, and a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (4) below:

Formula (4)

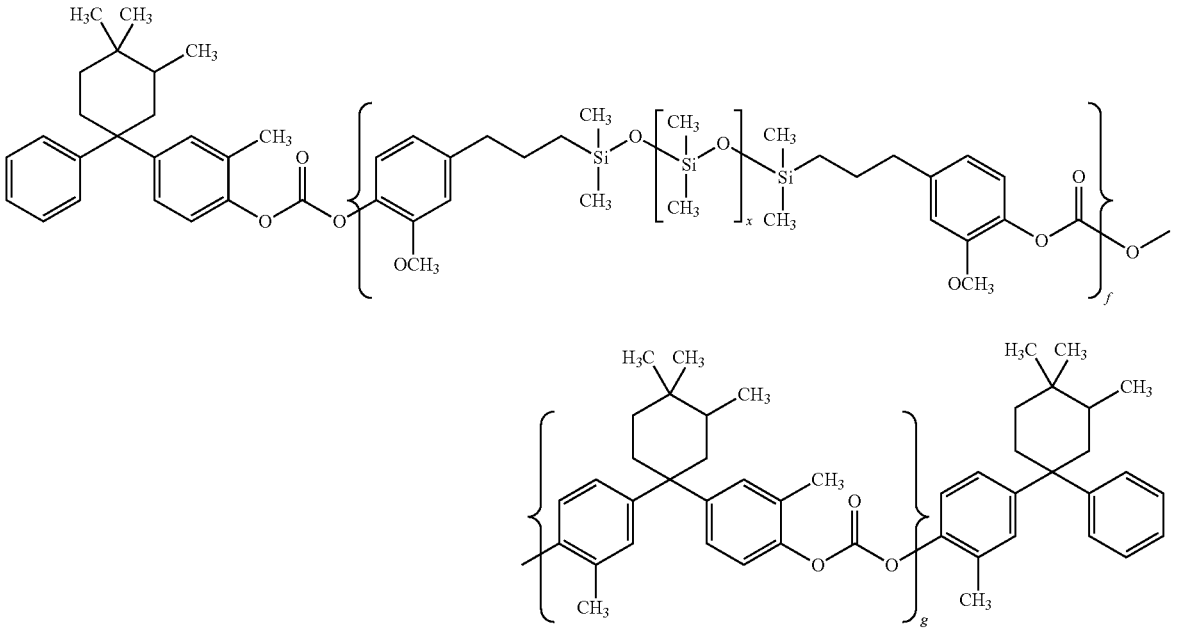

wherein x is a number from about 10 and about 50 while f an g are numbers representing the respective repeating units such that f is between about 1 and about 4 and g is from about 10 to about 100 for a weight average molecular weight of from about 15,000 to about 130,000 of the low surface energy polycarbonate, and mixtures thereof, and an anticurl back coating layer disposed on the flexible substrate on a side opposite the charge generating and charge transport layers.

21. An image forming apparatus for forming images on a recording medium comprising:

a) an imaging member having a charge retentive-surface for receiving an electrostatic latent image thereon, wherein the imaging member comprises a flexible substrate, a charge generating layer disposed on the substrate, at least one charge transport layer disposed on the charge generating layer, and an overcoat layer disposed over the at least one charge transport layer, wherein the overcoat layer comprises a blend of a polycarbonate binder and a low surface energy polycarbonate, and further wherein the polycarbonate binder is an A-B diblock copolymer comprising a bisphenol A polycarbonate segment block (A) and a phthalic acid containing segment block (B) terminal capable of providing protection against amine species contaminants, selected from the group consisting of Formula (I) and Formula (II) below:

Formula (I)

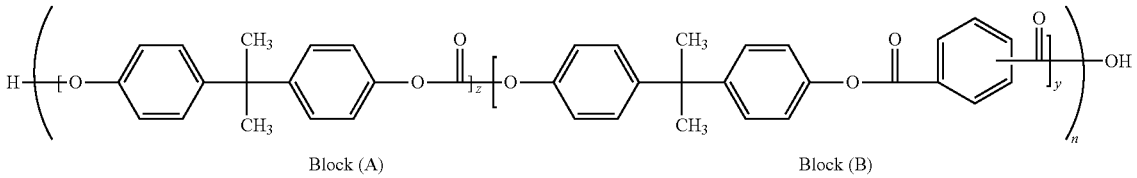

Formula (II)

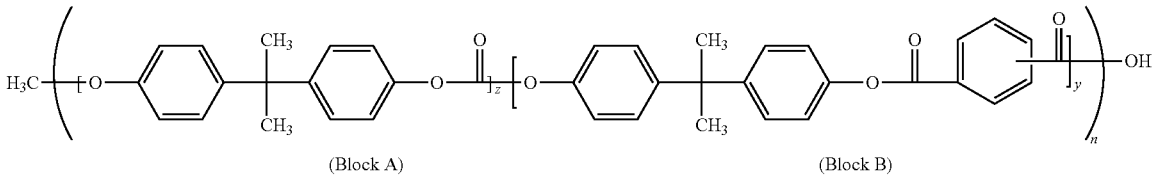

wherein z represents the number of bisphenol A repeating units in block A of from about 9 to about 18, y is number of repeating phthalic acid block B of from about 1 to about 2, and n is the degree of polymerization between about 20 and about 80 for the copolymer having a weight average molecular weight between about 100,000 and about 200,000, and mixtures thereof, while the low surface energy polycarbonate is selected from the group consisting of a bisphenol A polycarbonate of poly(4,4'-isopropylidene diphenyl carbonate) modified by including a small fraction of polydimethyl siloxane (PDMS) linkages in the main polycarbonate chain back bone to obtain Formula (1) below:

Formula (1)

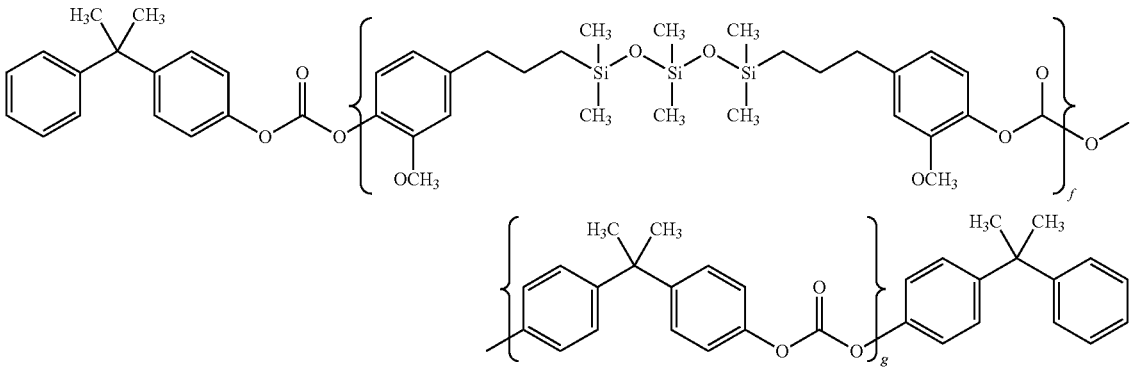

wherein x is a number from about 10 to about 50, and f and g are numbers representing each respective repeating segment such that f is from about 1 to about 4 and g is from about 10 to about 100 for a weight average molecular weight of from about 15,000 to about 130,000 of the low surface energy polycarbonate, a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (2) below:

Formula (2)

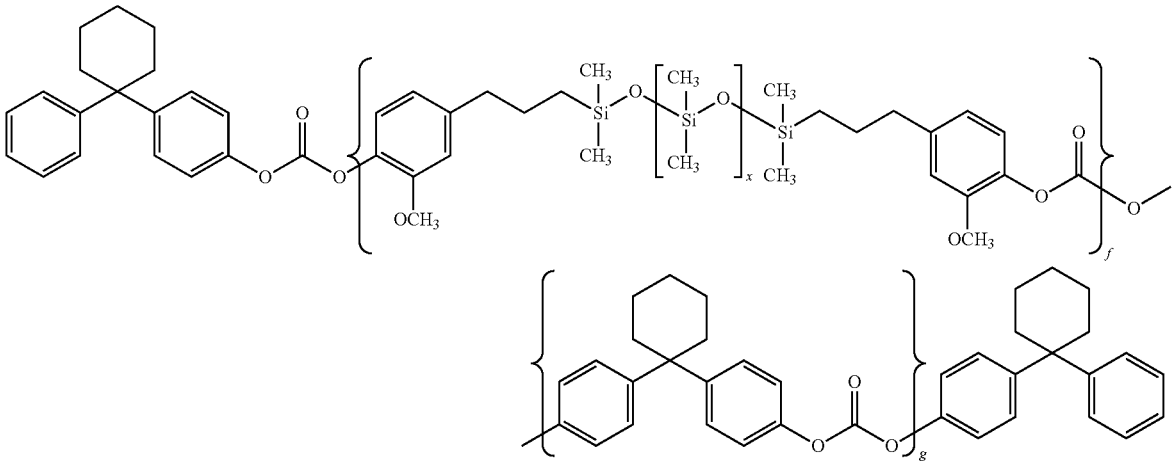

wherein x is a number from about 10 and about 50 while f and g are numbers representing each respective repeating units such that f is between about 1 and about 4 and g is from about 10 to about 100 for a weight average molecular weight of from about 15,000 to about 130,000 of the low surface energy polycarbonate, a bisphenol C polycarbonate of poly(4,4'-isopropylidene diphenyl carbonate) modified by including a small fraction of polydimethyl siloxane (PDMS) linkages into the main polycarbonate chain back bone to obtain Formula (3) below:

Formula (3)

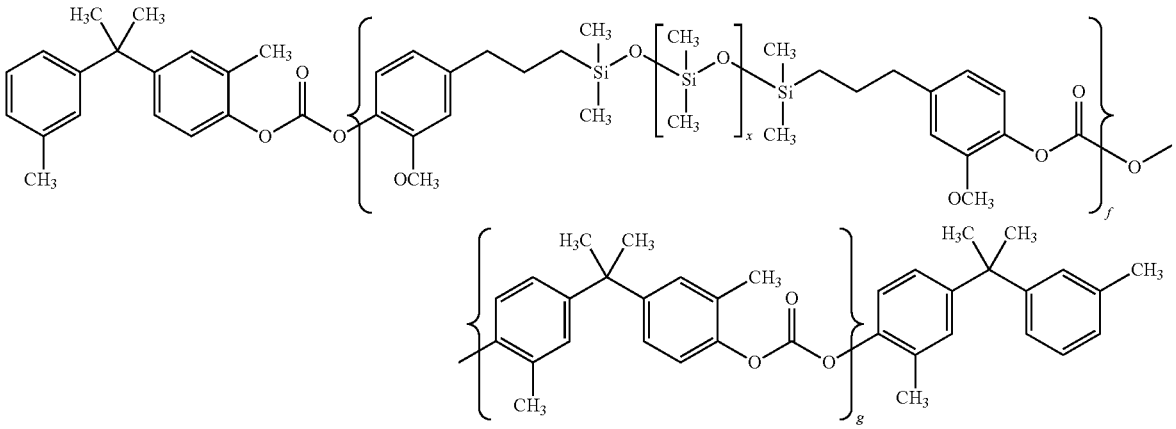

wherein x is a number from about 10 and about 50 while f and g are numbers representing the respective repeating units such that f is between about 1 and about 4 and g is from about 10 to about 100 for a weight average molecular weight of from about 15,000 to about 130,000 of the low surface energy polycarbonate, and a bisphenol Z polycarbonate of poly(4,4'-diphenyl-1,1'-cyclohexane carbonate) modified by including a small fraction of polydimethyl siloxane (PDMS) linkages into the main polycarbonate chain back bone to obtain Formula (4) below:

Formula (4)

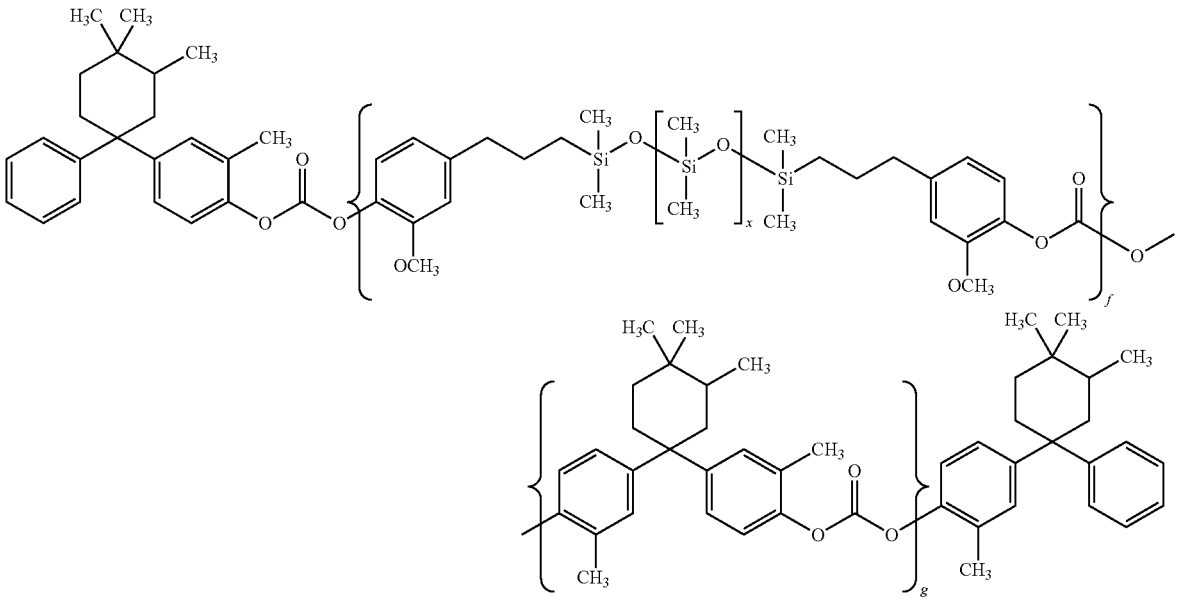

wherein x is a number from about 10 and about 50 while f and g are numbers representing the respective repeating units such that f is between about 1 and about 4 and g is from about 10 to about 100 for a weight average molecular weight of from about 15,000 to about 130,000 of the low surface energy polycarbonate, and mixtures thereof, and an anticurl back coating layer disposed on the flexible substrate on a side opposite the charge generating and charge transport layers;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

* * * * *